US009549647B2

(12) United States Patent
Leibfried

(10) Patent No.: US 9,549,647 B2
(45) Date of Patent: Jan. 24, 2017

(54) RELEASABLE TOILET SEAT HINGE

(71) Applicant: Michael R. Leibfried, Lancaster, WI (US)

(72) Inventor: Michael R. Leibfried, Lancaster, WI (US)

( * ) Notice: Subject to any disclaimer, the term of this patent is extended or adjusted under 35 U.S.C. 154(b) by 283 days.

(21) Appl. No.: 13/755,535

(22) Filed: Jan. 31, 2013

(65) Prior Publication Data

US 2013/0198942 A1 Aug. 8, 2013

Related U.S. Application Data

(60) Provisional application No. 61/594,809, filed on Feb. 3, 2012.

(51) Int. Cl.
*A47K 13/12* (2006.01)
*A47K 13/26* (2006.01)

(52) U.S. Cl.
CPC ..... *A47K 13/12* (2013.01); *A47K 13/26* (2013.01)

(58) Field of Classification Search
CPC ..... A47K 13/12; A47K 13/26
USPC ..... 4/236, 240
See application file for complete search history.

(56) References Cited

U.S. PATENT DOCUMENTS

| | | | | |
|---|---|---|---|---|
| 5,933,875 | A * | 8/1999 | Hulsebus et al. | 4/240 |
| 6,070,295 | A * | 6/2000 | Hulsebus | 16/254 |
| 6,089,807 | A | 7/2000 | Larsson | |
| 7,155,748 | B2 | 1/2007 | Vierkant, III et al. | |
| 7,203,975 | B2 * | 4/2007 | Vierkant, III | A47K 13/26 4/236 |
| 7,281,276 | B2 * | 10/2007 | Vierkant et al. | 4/240 |
| 8,943,618 | B2 * | 2/2015 | Dundas et al. | 4/240 |
| 2006/0064808 | A1 * | 3/2006 | Vierkant | 4/236 |
| 2008/0172780 | A1 * | 7/2008 | Shiau | A47K 13/24 4/236 |
| 2009/0000017 | A1 * | 1/2009 | Zhou | 4/236 |
| 2012/0110723 | A1 * | 5/2012 | Shih | 4/240 |
| 2012/0167291 | A1 * | 7/2012 | Zhou | 4/236 |
| 2013/0067647 | A1 | 3/2013 | Stelter et al. | |
| 2013/0340154 | A1 * | 12/2013 | Hand et al. | 4/240 |
| 2014/0157500 | A1 * | 6/2014 | Dundas et al. | 4/236 |
| 2014/0189947 | A1 * | 7/2014 | Murphy et al. | 4/420 |

FOREIGN PATENT DOCUMENTS

| | | |
|---|---|---|
| DE | 2723058 | 11/1978 |
| WO | WO9405919 | 3/1994 |

OTHER PUBLICATIONS

Kohler 1150464-0 White EB Hinge Kit for Elongated Toilet Seat 1150464—Reviews & Prices @ Yahoo! Shopping.

(Continued)

*Primary Examiner* — Paul R Durand
*Assistant Examiner* — William R Klotz
(74) *Attorney, Agent, or Firm* — Pepper Hamilton LLP

(57) ABSTRACT

A mounting apparatus for coupling a toilet seat to a toilet includes a bolt including a proximal end comprising an upper flange and a lower flange, the upper flange and lower flange defining a contact portion; and a threaded distal end; and a hinge including a first portion including a mechanism to rotatably couple the first portion to the toilet seat; and a second portion including a resilient member including a C-shaped engagement configured to be received by contact portion of the bolt via a snap fit in response to the application of a horizontal force to hinge.

16 Claims, 19 Drawing Sheets

(56) References Cited

OTHER PUBLICATIONS

"Slow Close Toilet Seats for Champion 4 Toilets" www.plumbingsupply.com, http://www.plumbingsuply.com/images/as-seat-champion-sloclose-5325-010-easy-hinge.Jpg (Accessed Aug. 8, 2013).

* cited by examiner

RELEASABLE TOILET SEAT HINGE

CROSS REFERENCE TO RELATED APPLICATIONS

This application claims priority to U.S. Provisional Application No. 61/594,809, filed: Feb. 3, 2012, which is hereby incorporated by reference in its entirety.

BACKGROUND

The present invention relates generally to the field of mounting apparatuses for toilet seats. In particular, the present invention relates to a toilet seat mounting device that is configured to be releasable without the need of tools, to facilitate easy and effective cleaning The tool-free releasable mounting devices facilitate the removal of the toilet seat from the toilet and the cleaning of the toilet around the toilet seat mounting area.

SUMMARY

One embodiment relates to a mounting apparatus for coupling a toilet seat to a toilet. The mounting apparatus includes a first portion configured to be coupled to the toilet seat and a second portion configured to be coupled to a mounting element of the toilet. The second portion includes an open end. The second portion is a resilient member that is coupled to the mounting element of the toilet with a snap fit by applying a horizontal force to the mounting apparatus to force the mounting element through the open end.

Another embodiment relates to a mounting apparatus for coupling a toilet seat to a toilet. The mounting apparatus includes a base and a dial. The base includes a first portion configured to be coupled to the toilet seat and a second portion configured to be coupled to a mounting element of the toilet. The second portion includes an opening and an open end. The dial includes an opening and an open end. The dial is coupled to the opening in the base. The dial may be rotated to selectively align the open end of the dial with the open end of the base to allow the passage of the mounting element of the toilet into or out of the opening in the dial.

Another embodiment relates to a mounting apparatus for coupling a toilet seat to a toilet. The mounting apparatus includes a base and a dial. The base includes a first portion configured to be coupled to the toilet seat and a second portion configured to be coupled to a mounting element of the toilet. The second portion includes an opening and an open end. The dial includes features to engage the opening of the base and the mounting element of the toilet. The dial may be selectively withdrawn away from the base to allow the passage of the mounting element of the toilet into or out of the opening in the base.

Another embodiment relates to a mounting apparatus for coupling a toilet seat to a toilet. The mounting apparatus includes a first portion configured to be coupled to the toilet seat, a second portion configured to be coupled to a mounting element of the toilet, and a cover. The second portion includes an open end defined by angled lead-in surfaces. The cover includes at least one protrusion and is moveable between an open position and a closed position. The protrusion obstructs the movement of the mounting element of the toilet through the open end when the cover is in the closed position.

Another embodiment relates to an apparatus for forming a resilient gasket bushing member in an aperture. The apparatus includes a fastening member disposed in the aperture and a multi-part gasket bushing compound. The fastening member including a passage with an inlet that is accessible when the fastening member is disposed in the aperture and an outlet in the aperture. The multi-part gasket bushing compound is delivered to the aperture through the passage, with the aid of weep holes incorporated into the fastening member.

In another aspect, a mounting apparatus for coupling a toilet seat to a toilet is provided, the mounting apparatus including a bolt including a proximal end comprising an upper flange and a lower flange, the upper flange and lower flange defining a contact portion, and a threaded distal end; and a hinge including a first portion comprising a mechanism to rotatably couple the first portion to the toilet seat; and a second portion including a resilient member comprising a C-shaped engagement configured to be received by contact portion of the bolt via a snap fit in response to the application of a horizontal force to hinge. In some embodiments, the mounting apparatus further includes a cover disposed over the bolt. In other embodiments, the mechanism includes a horizontal shaft in the first portion, and a pin inserted in the shaft, the cover being generally rotatable around the pin. In another aspect, a toilet seat mounting system includes two such mount apparatuses.

In another aspect, an apparatus for forming a gasket member in an aperture is provided, the apparatus including a fastening member disposed in the aperture, the fastening member including a passage in fluid communication with an exterior of the fastening member when disposed in the aperture, and the aperture; and a gasketing composition; wherein: the gasketing composition is configured to be delivered to the aperture through the passage.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

DETAILED DESCRIPTION

Referring generally to the figures, a mounting apparatus configured to couple a toilet seat to a toilet is shown. In one embodiment, the toilet seat mounting apparatus includes a hinge that is releasably coupled to a hinge post to facilitate cleaning In this embodiment, a horizontal force may be applied away from the toilet tank to causes one of the releasable hinges to disengage from the hinge posts. With one hinge released, the other hinge provides a pivot about which the seat can be rotated. This exposes areas of the toilet bowl flange that may otherwise be covered by the components of the mounting apparatus, allowing the previously covered area to be cleaned, repaired, etc. After cleaning the exposed area, the releasable hinge may be engaged to the hinge post once again. A similar force can be applied to disengage the other releasable hinge to repeat the cleaning operation on the other side. In other embodiments, a horizontal force may be applied away from the toilet tank to cause both of the releasable hinges to disengage from the hinge posts to fully remove the seat and facilitate cleaning of the toilet. The toilet seat mounting apparatus may be used in residential or commercial restrooms.

Figure 1:
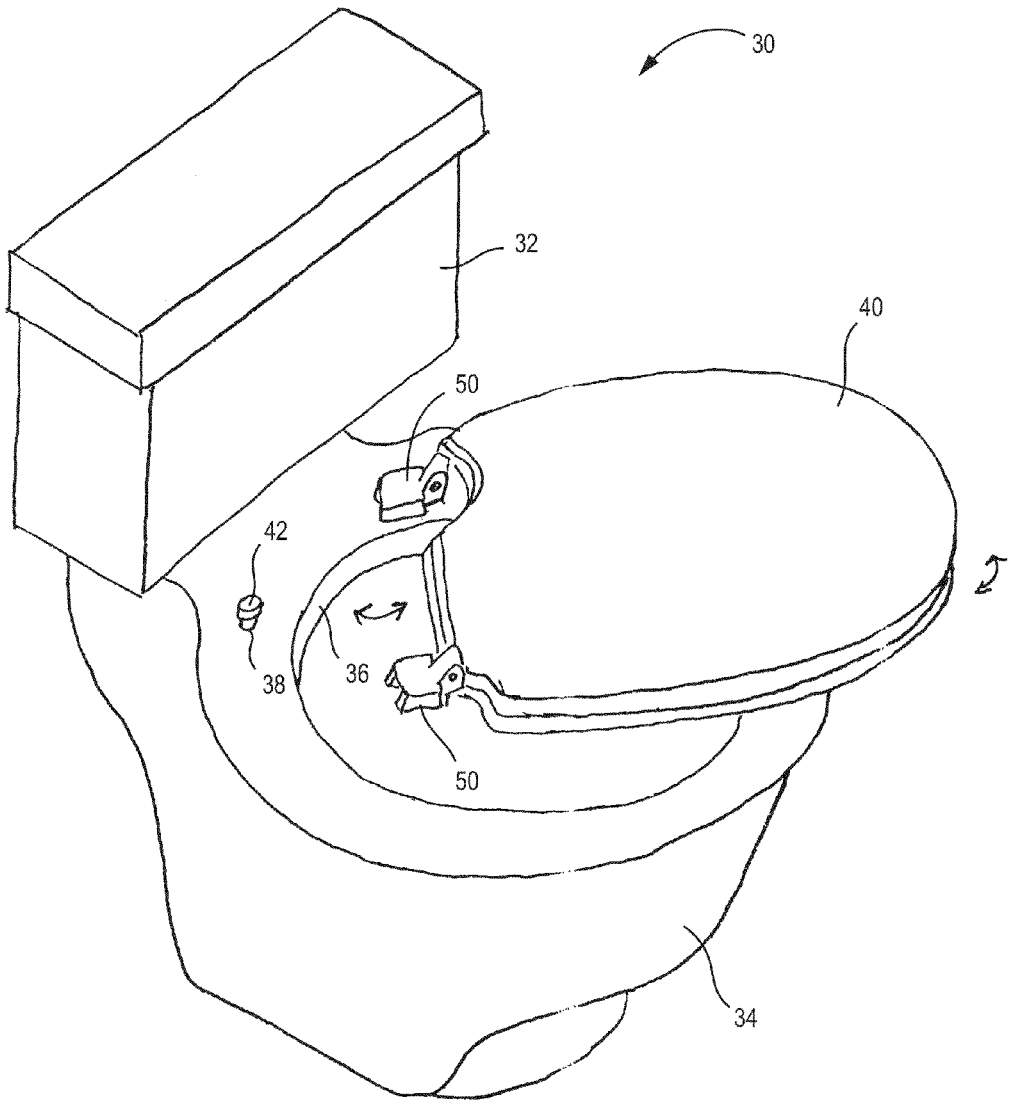
FIG. 1 is an isometric view of a toilet seat cover and ring coupled to a toilet with releasable hinges, according to an exemplary embodiment.

Referring to FIG. 1, a toilet 30 is shown according to an exemplary embodiment. A toilet seat 40 is coupled to the toilet 30 with one or more seat mounting devices, or hinges 50. The hinges 50 are configured to be releasable to facilitate the removal of the seat 40 and the cleaning of the toilet 30. The toilet 30 includes a bowl 34 and may include a tank or reservoir 32. A flange 36 extends inwardly around the rim of the bowl 34.

Figure 2:
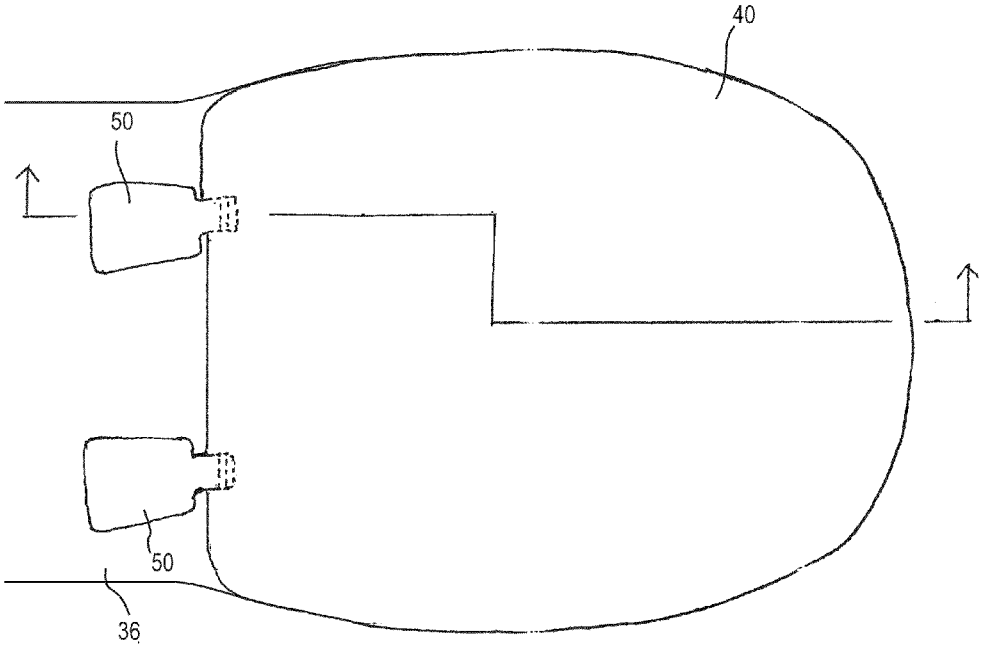
FIG. 2 is a top view of a toilet seat cover with releasable hinges, according to an exemplary embodiment.
Figure 3:
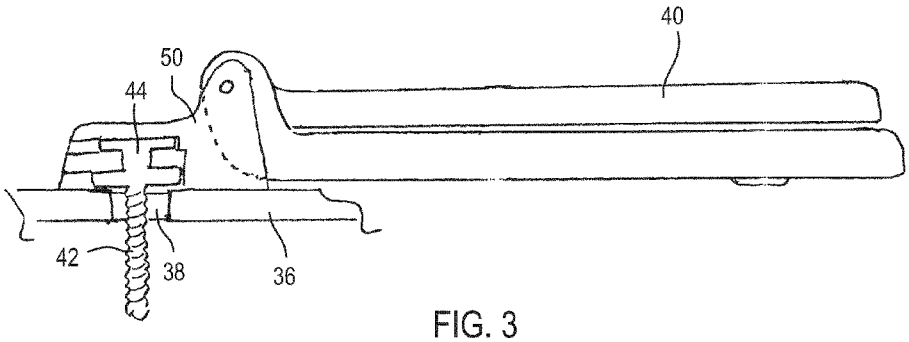
FIG. 3 is a cross section of the toilet seat of FIG. 2 taken along line 3-3.
Figure 4:
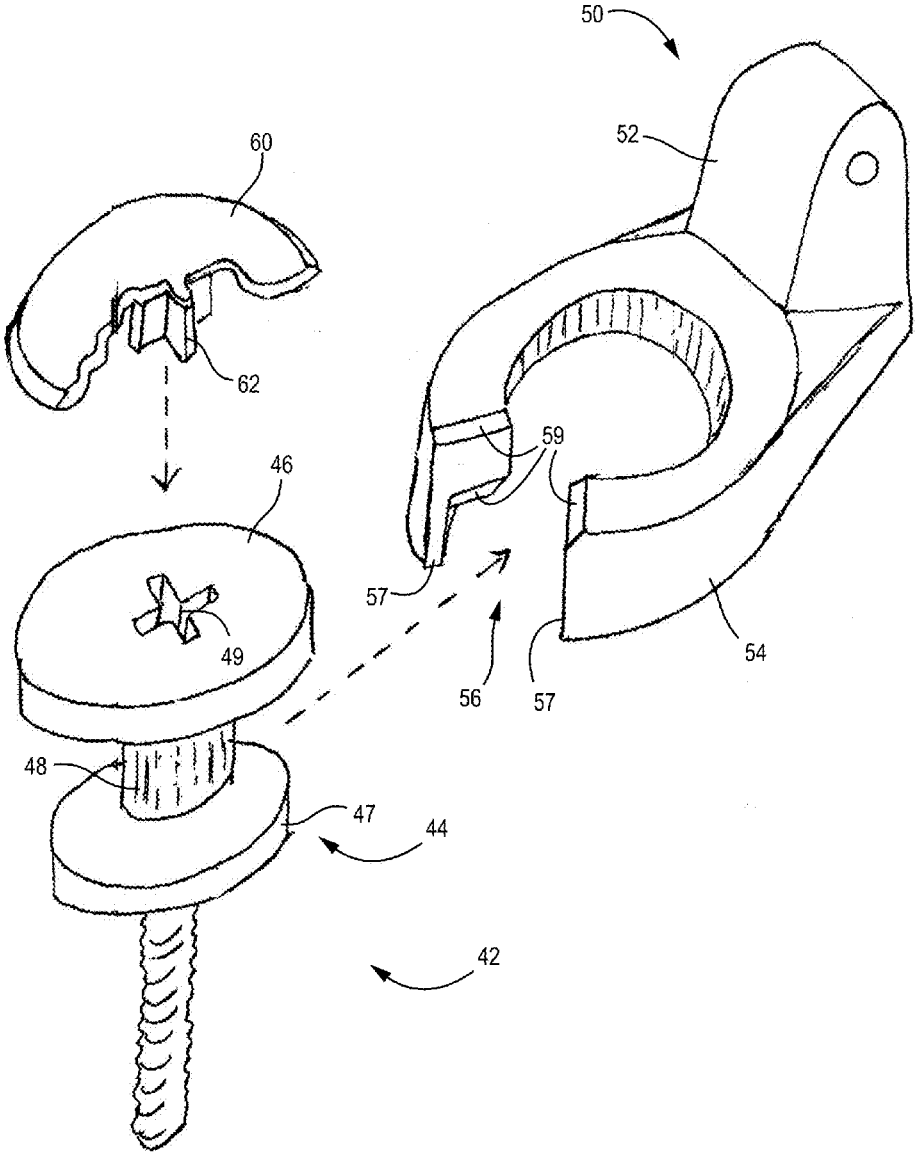
FIG. 4 is an exploded view of a hinge, according to an exemplary embodiment.
Figure 5:
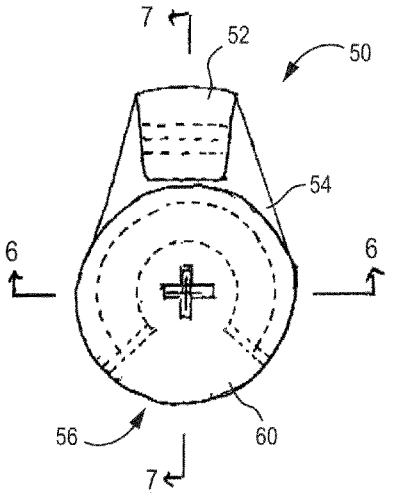
FIG. 5 is a top view of the hinge of FIG. 4.
Figure 6:
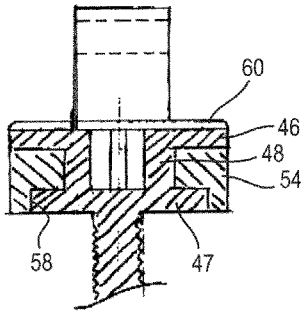
FIG. 6 is a cross section of the hinge of FIG. 5 taken along line 6-6.
Figure 7:
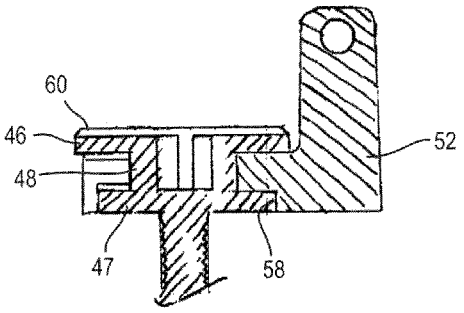
FIG. 7 is a cross section of the hinge of FIG. 5 taken along line 7-7.

Referring now to FIGS. 2 and 3, the toilet bowl flange 36 includes at least one aperture 38. A bolt 42 (e.g., post, etc.) is received within each aperture 38. The bolt 42 includes an upper portion 44. According to an exemplary embodiment, the bolt 42 is a threaded member that engages a threaded nut (not shown) provided on the opposite side of the flange 36. The aperture 38 has a diameter that is larger than the threaded portion of the bolt 42, but smaller than the diameter of the upper portion 44. The hinges 50 engage the upper portions 44 of the bolts 42. Through the interconnection of the bolts 42, the hinges 50, and the nuts, the toilet seat 40 may be coupled to toilet bowl flange 36.

In a use position, with both hinges 50 engaged to the bolts 42, the lower surface of the hinges 50 are in contact with the toilet bowl flange 36, and the hinges 50 act to prevent or prohibit access to portions of the toilet bowl flange 36. FIG. 1 shows the toilet seat 40 in the maintenance or cleaning position. A horizontal force applied to the seat 40 in a direction opposite of the tank 32 may be used to disengage one of the hinges 50. This causes the seat 40 to pivot about the other hinge 50, exposing a previously covered portion of the toilet bowl flange 36. This arrangement provides accessibility to a previously covered area of the toilet bowl flange 36 while allowing the toilet seat 40 to remain attached to the toilet 30. In one embodiment, access to the flange 36 may be desirable for maintenance purposes (e.g., cleaning, repair, etc.).

While the toilet seat 40 will be generally described as being coupled to the toilet 30 with one or more threaded bolts 42 and one or more threaded nuts, in other embodiments, the hinges 50 may engage other members to couple the toilet seat 40 to the toilet 30. In one embodiment, both the aperture 38 and bolt 42 may be threaded. In this embodiment, the bolt 42 is coupled to the toilet bowl flange 36 by threading bolt 42 into aperture 38. In other embodiments, the bolt 42 may or may not be included. In one such embodiment, the toilet bowl flange 36 may include a projection integral with flange 36 and similar in structure to the upper portion 44 of the bolt 42. In this embodiment, the hinge 50 may be directly coupled to the integral projection.

Referring now to FIGS. 4-7, the hinge 50 is shown according to one exemplary embodiment. As generally described above, the hinge 50 engages the top portion 44 of the bolt 42 to couple the seat 40 to the toilet 30 with a snap fit.

As shown, the top portion 44 of the bolt 42 includes a first or upper flange 46, a second or lower flange 47, and a contact portion 48 disposed between the upper flange 46 and the lower flange 47. The lower flange 47 rests upon the toilet bowl flange 36. The upper flange 46 may include a recess 49, such as a recess commonly known for use with a screwdriver (e.g., a slot, a Phillips-type cross, a square, a hexagon, etc.).

The hinge 50 is formed of a resilient material and includes a base 52 that is coupled to the seat 40, such as with a pinned connection that allows the seat 40 to rotate relative to the hinge 50. The hinge 50 further includes a generally C-shaped annular engagement portion 54 with a gap or opening 56 opposite of the base 52 defined by angled lead-in surfaces 57. The opening 56 is narrower than the diameter of the contact portion 48 of the bolt 42. The engagement portion 54 flexes during the coupling process between the hinge 50 and the bolt 42, while the base 52 remains relatively static.

To couple the hinge 50 to the bolt 42, a horizontal force is applied to the hinge 50 via the seat 40, pressing the lead-in surfaces 57 against the contact portion 48 of the bolt 42. The contact portion 48 causes the engagement portion 54 to flex outward. Continued force applied to the hinge 50 causes the bolt 42 to pass through the opening 56 until it is received and generally surrounded by the engagement portion 54. The engagement portion 54 may further include beveled edges 59 on either or both of the upper and lower edges of the lead-in surfaces 57 to guide or facilitate the positioning of the engagement portion 54 between the upper flange 46 and the lower flange 47.

According to various exemplary embodiments, the engagement portion 54 may have an inner diameter that is less than the diameter of the contact portion 48 of the bolt 42, creating an interference fit between the hinge 50 and the bolt 42 or may have a diameter that is greater than the diameter of the contact portion 48 of the bolt 42, creating a clearance between the hinge 50 and the bolt 42 and allowing the seat to be more easily rotated about a bolt 42 when one of the hinges 50 is disengaged.

The upper flange 46 rests on top of the engagement portion 54 of the hinge 50. The lower flange 47 is received in a hollow or recess 58 in the engagement portion 54, allowing both the hinge 50 and the lower flange 47 of the bolt 42 to rest on the toilet bowl flange 36.

The upper flange 46 has a diameter that is greater than the inner diameter of the engagement portion 54. In this way, the hinge 50 is prevented from being removed from the bolt 42 in the vertical direction. The hinge 50 is effectively trapped between the upper flange 46 and the lower flange 47. The spring clamping force of the hinge material prevents incidental horizontal forces from normal use of the toilet 30 from dislodging the seat 40 and the hinge 50 from being removed from the bolt 42.

A cap 60 (e.g., cover, lid, trim piece, etc.) may be utilized to conceal the upper flange 46 and provide an aesthetically pleasing appearance. According to an exemplary embodiment, the cap 60 is a generally round, disk-shaped body, with an outer circumference that is similar to the outer circumference of the engagement portion 54 of the hinge 50. The cap 60 includes a protrusion 62 that is configured to be received in the recess 49 in the upper flange 46 of the bolt 42. An interference fit between the protrusion 62 and the upper flange 46 couples the cap 60 to the bolt 42. Optionally, a snap fit configuration could be used to connect cap 60 to bolt 42.

As described above, an outward horizontal force applied to the seat may be used to free the bolt 42 out of the opening 56 in the engagement portion 54 thus disengaging the hinge from the bolt 42. The cap 60 can remain coupled to the bolt 42 when the hinge 50 is disengaged.

According to an exemplary embodiment, the hinge 50 is formed of an injection molded polymer such as nylon or polypropylene, but in other embodiments, the hinge 50 may be formed of any material that has a sufficient strength to withstand repeated use and movement of the seat while still being flexible enough to flex as the hinge 50 engages the bolt 42.

The force required to pass the bolt 42 through the opening 56 in the hinge 50 may be varied based on the dimensions of the engagement portion 54 (e.g., thickness, size of the opening, etc.), the dimensions of the bolt 42 (e.g., the diameter of the contact portion 48, etc.), or the materials used to form the hinge 50 or the bolt 42. It is intended that the force needed to disengage one of the hinges 50 from the corresponding bolt 42 is greater than the incidental forces applied to the seat 40 during normal use, but not so excessive that an average user is unable to remove the seat 40.

Figure 8:
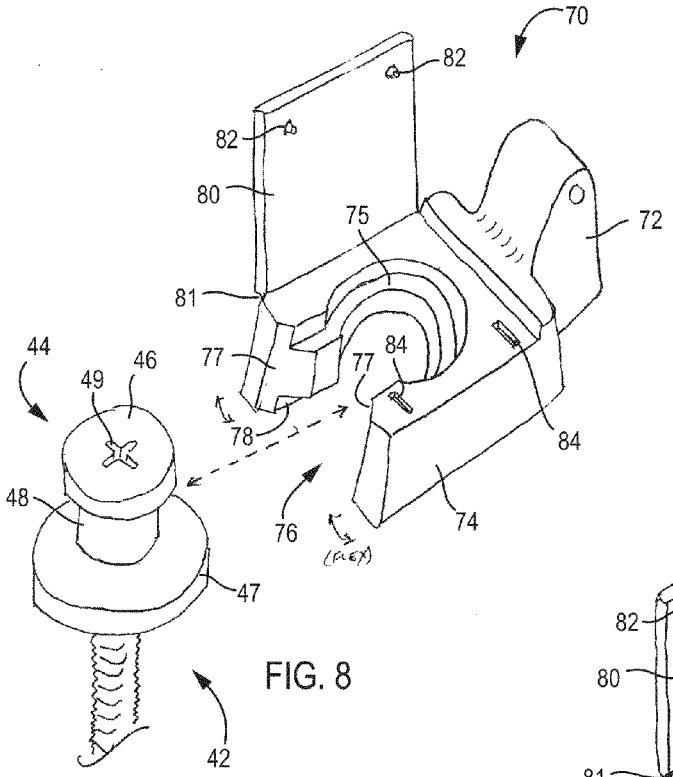
FIG. 8 is a perspective view of a hinge, according to another exemplary embodiment.

Referring now to FIGS. 8-12, a hinge 70 is shown according to other exemplary embodiments with an integrally formed cover 80. Referring especially to FIG. 8, the hinge 70 is similar to the hinge 50 and includes a base 72 that is coupled to the seat 40, such as with a pinned connection that allows the seat 40 to rotate relative to the hinge 70. The hinge 70 further includes an engagement portion 74 with a gap or opening 76 opposite of the base 72 defined by angled lead-in surfaces 77. The opening 76 is narrower than the diameter of the contact portion 48 of the bolt 42.

Similar to the hinge 50, the hinge 70 is coupled to the bolt 42 when a horizontal force is applied to the hinge 70 via the seat 40, pressing the lead-in surfaces 77 against the contact portion 48 of the bolt 42. When the hinge 70 is coupled to the bolt 42, the upper flange 46 rests on top of a recessed ledge 75 on the engagement portion 74 of the hinge 70. The lower flange 47 is received in a hollow or recess 78 in the engagement portion 74, allowing both the hinge 70 and the lower flange 47 of the bolt 42 to rest on the toilet bowl flange 36.

As shown in FIGS. 9-12, the bolt 42 may not include a lower flange 47 and the hinge 70 may therefore lack a corresponding hollow.

Figure 9:
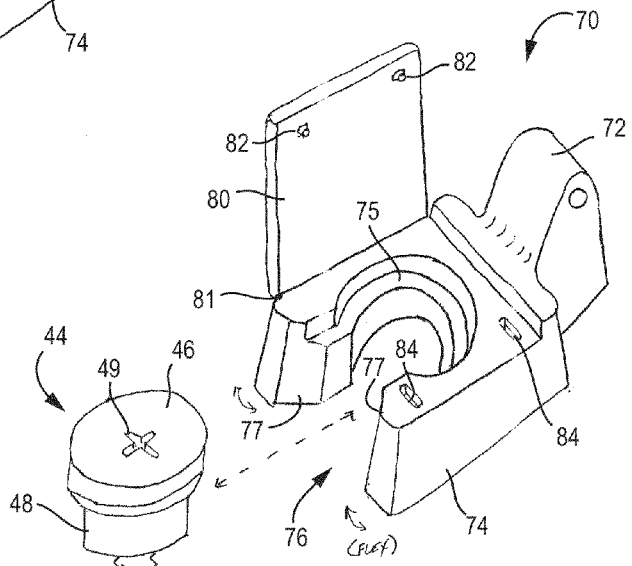
FIG. 9 is a perspective view of a hinge, according to another exemplary embodiment.
Figure 10:
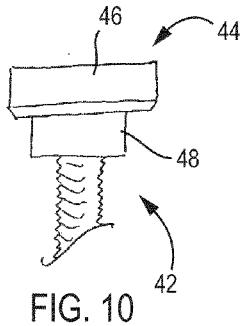
FIG. 10 is a side view of an alternate bolt configuration to which the hinge of FIG. 9 is coupled.
Figure 11:
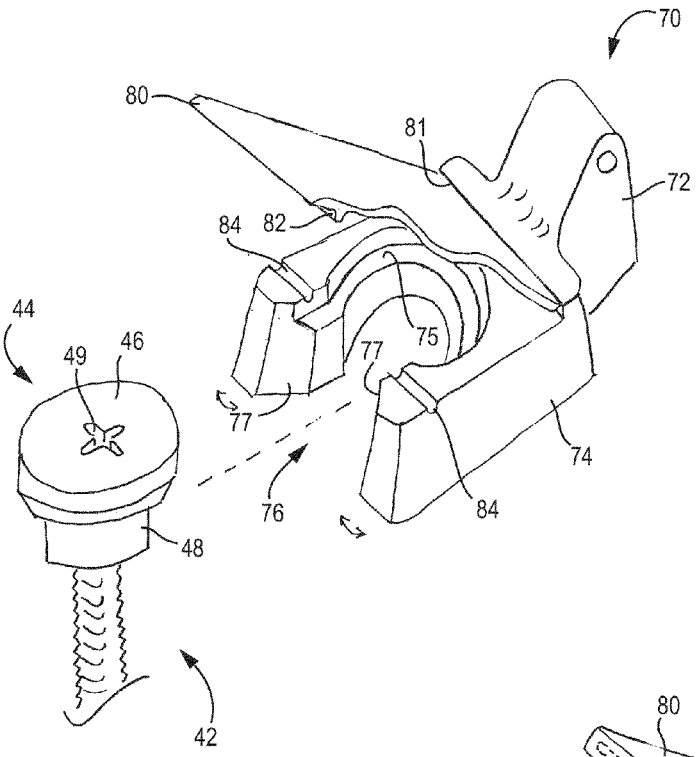
FIG. 11 is a perspective view of a hinge, according to another exemplary embodiment.
Figure 12:
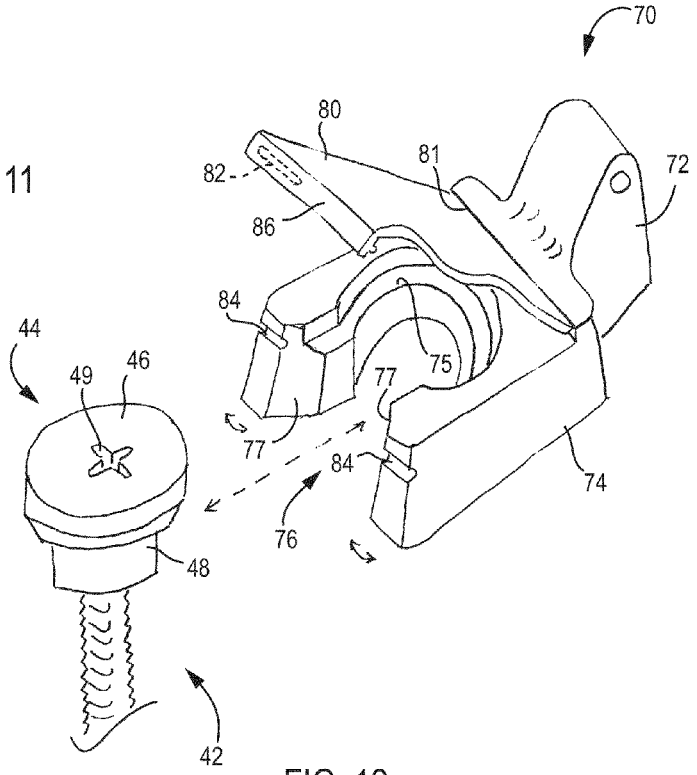
FIG. 12 is a perspective view of a hinge, according to another exemplary embodiment.

Unlike the hinge 50, the hinge 70 includes an integrally formed cover 80 instead of a separate component, such as cap 60. The cover 80 is coupled to the hinge 70 along one side of engagement portion 74 with a living hinge 81. As shown in FIGS. 8-9, the living hinge 81 may be provided along an outside edge of the engagement portion 74. As shown in FIGS. 11-12, in other embodiments, the living hinge 81 may be provided along the edge of the engagement portion 74 adjacent to the base 72.

The cover 80 is moveable between an open position, in which the upper portion 44 of the bolt 42 is accessible, and a closed position in which the bolt 42 is concealed from view. The cover 80 is retained in the closed position with a snap fit between one or more projections 82 (e.g., snaps, protrusions, pegs, etc.) that are received in corresponding recesses 84 (e.g., sockets, etc.). The recesses 84 are formed as slots, with a longitudinal axis that allows the projections 82 to remain coupled to the recesses 84 even as the engagement portion 74 flexes relative to the cover 80 when the bolt 42 is forced through the opening 76 (e.g., generally perpendicular to the motion of the bolt 42 as it passes through the opening 76).

As shown in FIGS. 8 and 9, the projections 82 may extend from the lower surface of the cover 80 and the recesses 84 may be formed in the top surface of the engagement portion 74. As shown in FIG. 11, a single, elongated projection 82 may extend from the lower surface of the cover 80 and be received in recesses 84 that are formed in the top surface of the engagement portion 74. As shown in FIG. 12, in other embodiments, the cover may include a rim 86 (e.g., lip, side wall, etc.) along one side. One or more projections 82 may extend inwardly from the rim 86 to be received in recesses 84 formed on an outer side wall of the engagement portion 74.

While FIGS. 8-12 shows the projections 82 extending from the cover 80 and the recesses 84 being formed in the engagement portion 74 of the hinge 70, the relative position of the two features may be reversed.

Figure 13:
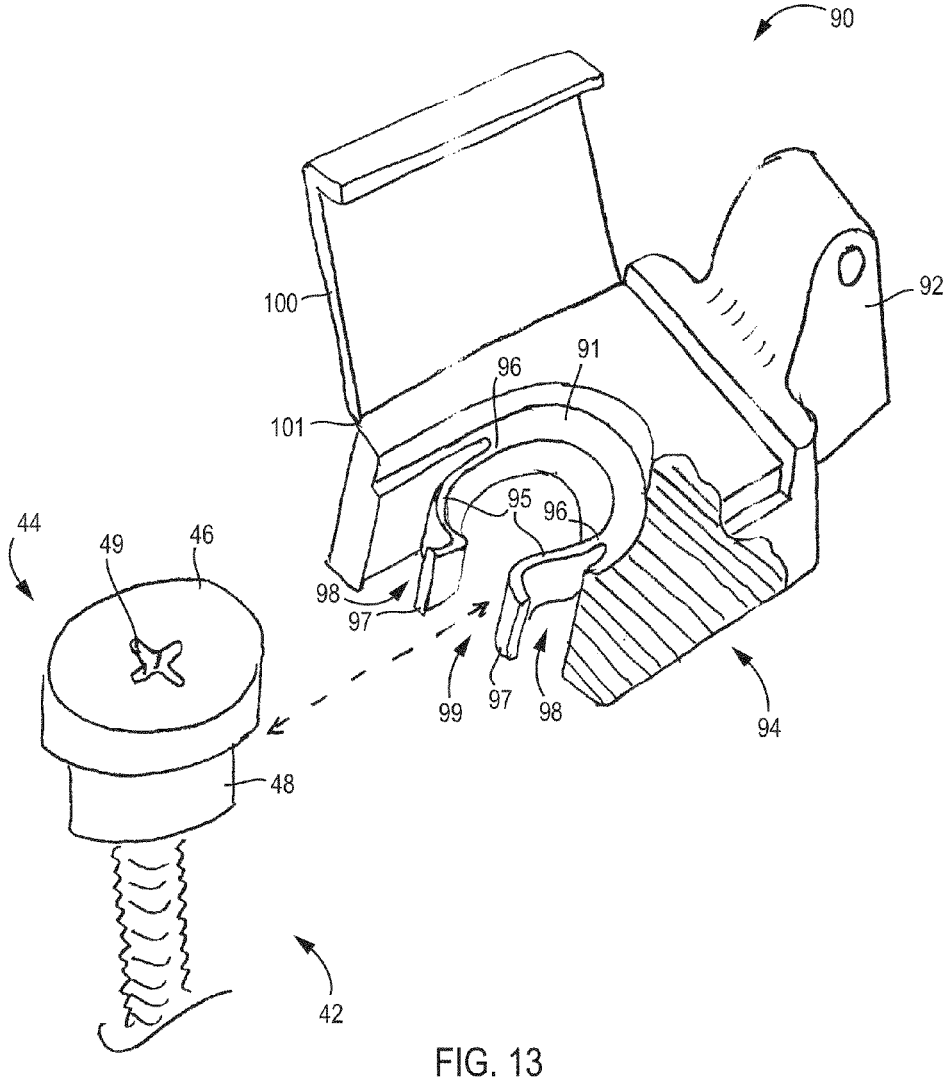
FIG. 13 is a perspective view of a hinge, according to another exemplary embodiment.

Referring now to FIGS. 13-16, a hinge 90 is shown according to other exemplary embodiments. Referring especially to FIG. 13, the hinge 90 is similar to the hinge 70 and includes a base 92 that is coupled to the seat 40, such as with a pinned connection that allows the seat 40 to rotate relative to the hinge 90. However, whereas the entire engagement portion 74 of the hinge 70 was configured to flex or distort when the bolt 42 was forced through the opening 76, the engagement portion 94 of the hinge 90 includes a pair of internal flexible arms 95 that receive the bolt 42.

The flexible arms 95 are cantilevers that each include a fixed end 96 and a free end 97. The flexible arms 95 are separated from the base 92 by gaps 98 that allow the free ends 97 to move relative to the base 92. A gap or opening 99 for receiving the bolt 42 is defined by the free ends 97 opposite of the base 92. The opening 99 is narrower than the diameter of the contact portion 48 of the bolt 42. The free ends 97 are turned outward to form angled lead-in surfaces.

To couple the hinge 90 to the bolt 42, a horizontal force is applied to the hinge 90 via the seat 40, pressing the free ends 97 against the contact portion 48 of the bolt 42. The contact portion 48 causes the free ends 97 of the flexible arms 95 to flex outward. Continued force applied to the hinge 90 causes the bolt 42 to pass through the opening 99 between the free ends 97 until it is received and generally surrounded by the flexible arms 95. The engagement portion 94 may further include beveled edges to facilitate the positioning of the engagement portion 94 relative to the bolt 42. When the hinge 90 is coupled to the bolt 42, the upper flange 46 rests on top of a recessed ledge 91.

Figure 14:
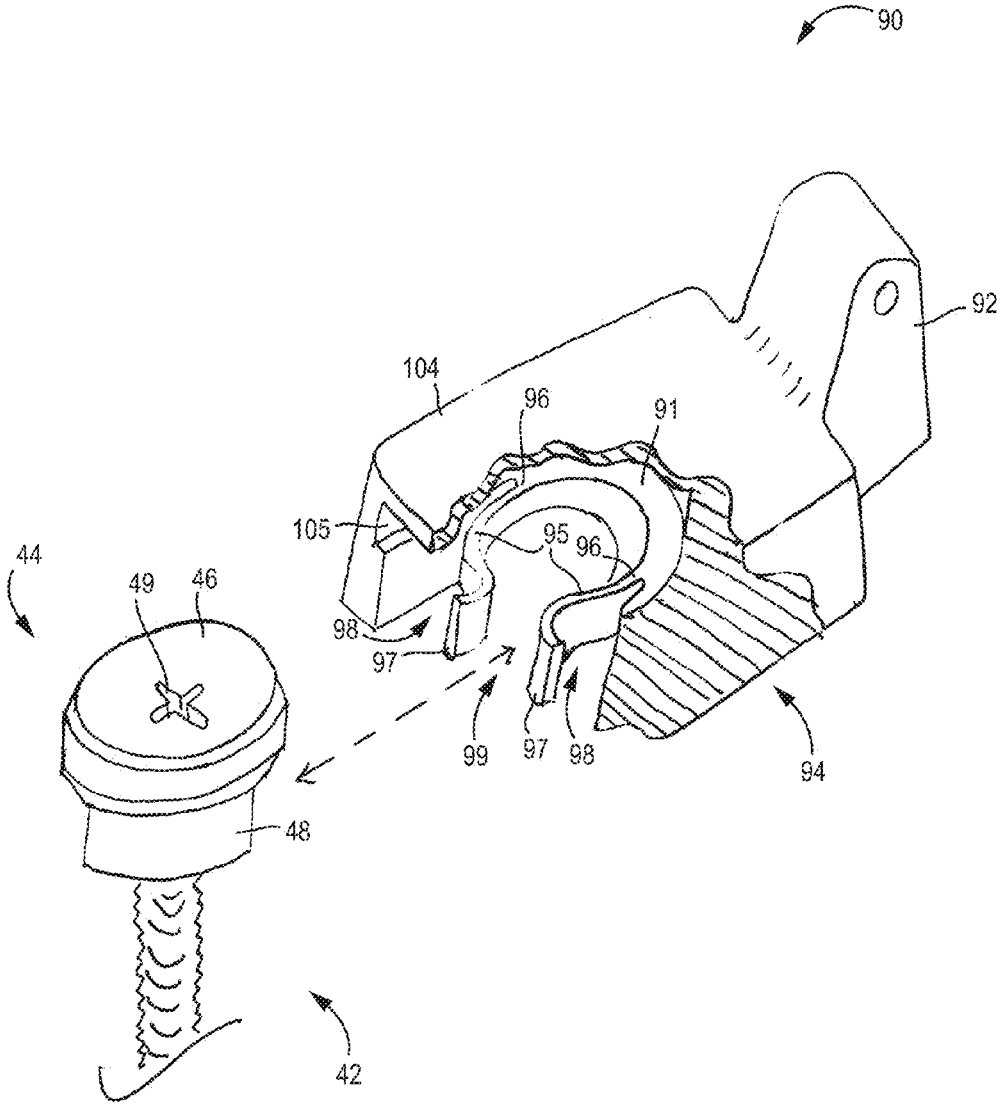
FIG. 14 is a perspective view of a hinge, according to another exemplary embodiment.
Figure 15:
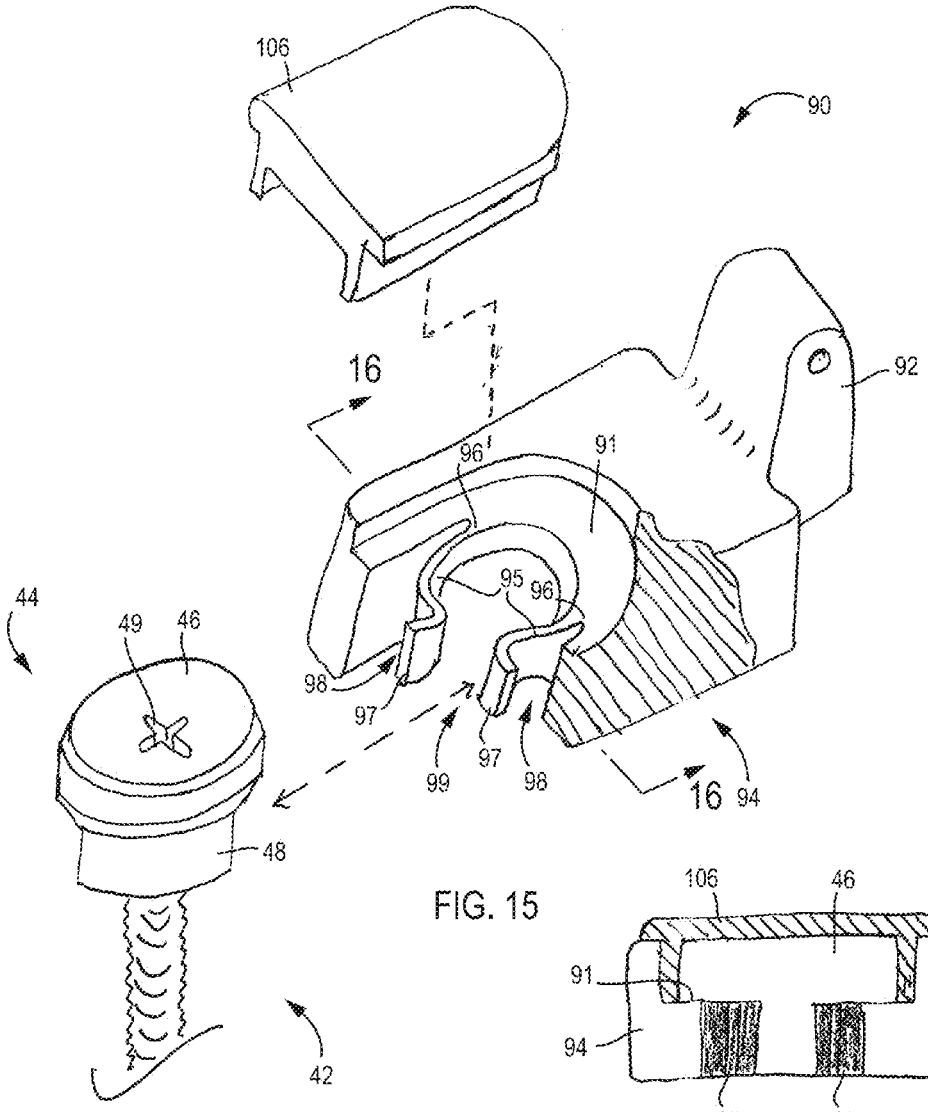
FIG. 15 is an exploded view of a hinge, according to another exemplary embodiment.
Figure 16:
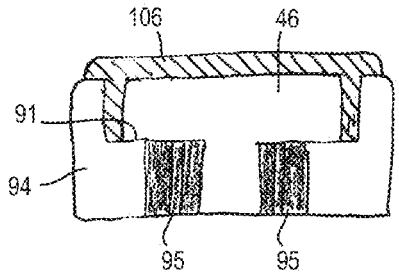
FIG. 16 is a cross section of the hinge of FIG. 15 taken along line 16-16.

Various structures and components may be used to conceal the bolt 42 from view when it is coupled to the hinge 90. As shown in FIG. 13, the hinge 90 may include an integrally formed cover 100 similar to the integrally formed cover 80 of hinge 70. The cover 100 is coupled to the hinge 90 along one side with a living hinge 101. As shown in FIG. 14, in another embodiment, a non-moveable cover 104 is integrally formed with the base 92 of the hinge 90. The upper flange 46 is received in a slot 105 formed between the cover 104 and the recessed ledge 91. The engagement portion 94 of the hinge 90 and/or the upper flange 46 of the bolt 42 may further include beveled edges to facilitate the positioning of the upper flange 46 into the slot 105. As shown in FIGS. 15-16, in another embodiment, a separate cover 106 is provided that is coupled to the hinge 90 with a snap fit.

Referring now to FIGS. 17-22, a hinge 110 is shown according to other exemplary embodiments. The hinge 110 includes a base 112 and a moveable dial 120 with a gate that allows a gap 116 in the base 112 to be manually opened and closed. Similar to the hinge 50, the hinge 110 may also include angled lead-in surface 117 on either side of the gap 116.

The dial 120 is hollow cylindrically shaped body with a central cavity 122 (e.g., hole, opening, aperture, etc.). The base 112 includes a circular opening 114 that receives the dial 120 with a snap-fit. The dial 120 may include one or more relief slots 124 to facilitate the insertion of the dial 120 into the opening 114. An outwardly extending flange 121 remains above the base 112 when the dial 120 is inserted into the circular opening 114. The flange 121 may be ergonomically shaped to allow a user to rotate the dial 120 relative to the base 112.

Figure 17:
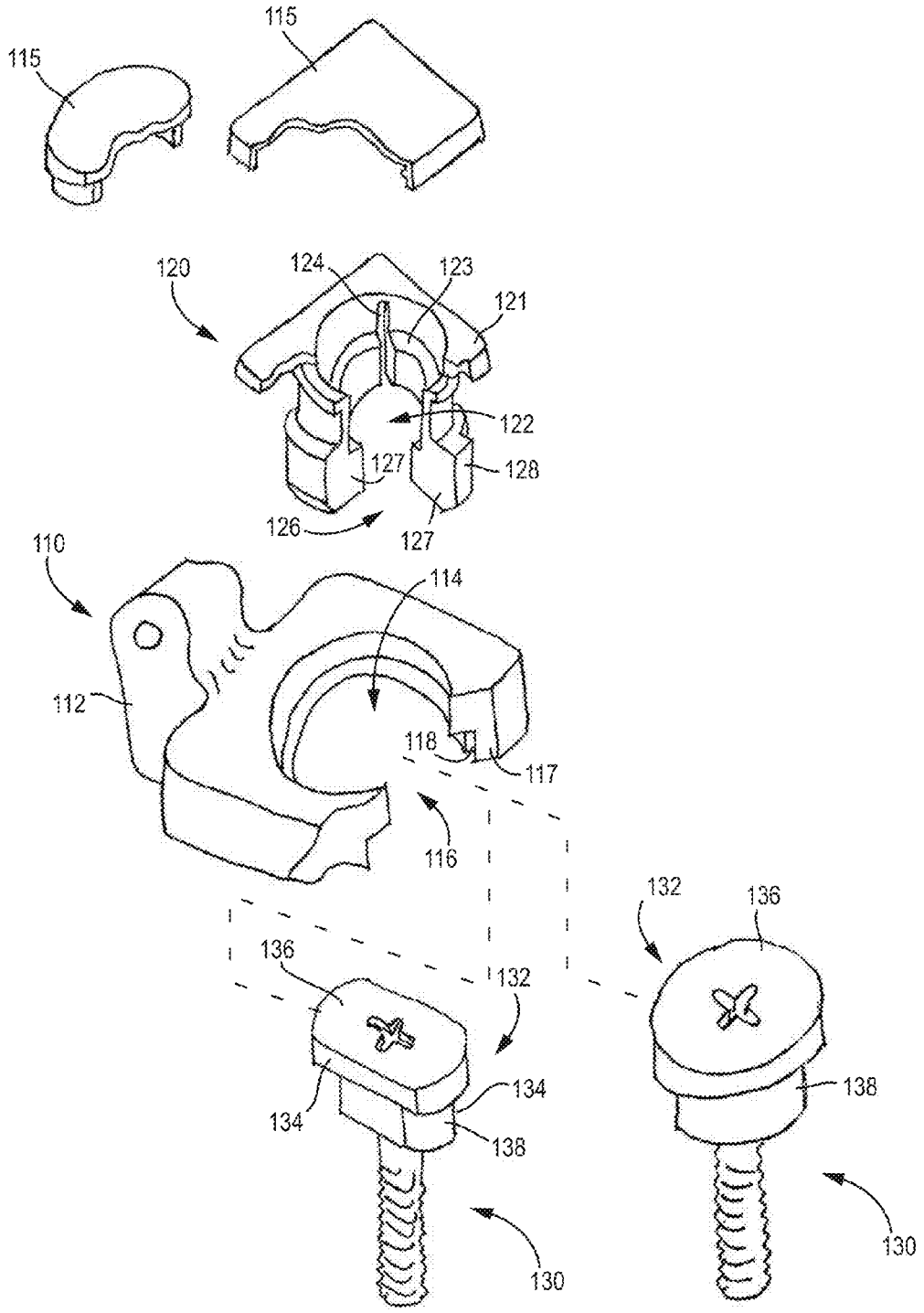
FIG. 17 is an exploded view of a hinge, according to another exemplary embodiment.
Figure 18:
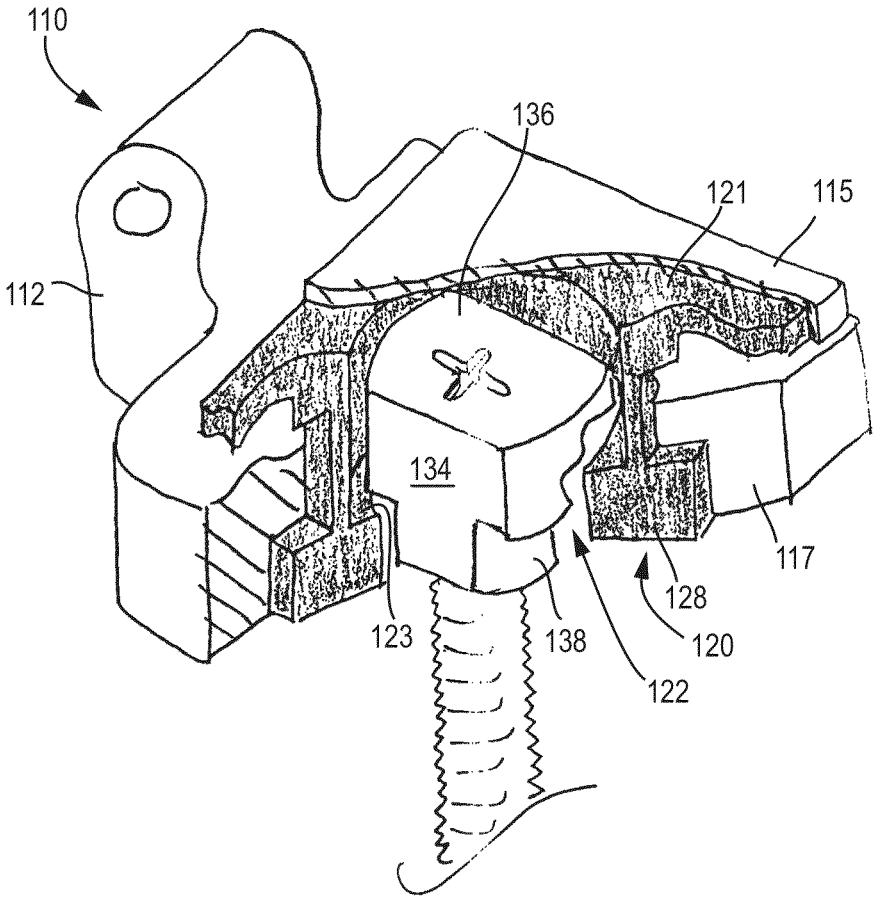
FIG. 18 is a breakaway perspective view of the hinge of FIG. 17.

A cap 115 may be coupled to the dial 120 to conceal the bolt 130. As shown in FIG. 17, the cap 115 may be configured to cover the entire flange 121 or may be configured to be inserted into the central cavity 122.

As shown in FIG. 17, the bolt 130 may be a round bolt, similar to the bolt 42 used with hinge 50, hinge 70, or hinge 90 in which flex would occur within hinge 110 and dial 120, upon engagement and disengagement. As with previously mentioned embodiments. Alternatively bolt 130 may have flats 134. The flats 134 narrow both the upper flange 136 and the contact portion 138. The narrowed upper portion 132 can pass through the gap 116 and gap 126 without requiring hinge 110 or dial 120 to flex.

The hinge 110 will be described below as being used with a bolt 130 that is narrowed with flats 134. Because the hinge 110 is not distorted by the bolt 130 as it passes through the gap 116, the hinge 110 and the dial 120 may be formed from either a resilient material or a rigid material. In other embodiments, the hinge 110 may be configured to be coupled to a round bolt 130 that distorts the hinge 110 and dial 120 as it passes through the gap 116 and gap 126, therefore the hinge 110 and the dial 120 are formed of a resilient material, such as polypropylene or nylon.

Referring now to FIGS. 18-21, the operation of the dial 120 to open and close the hinge 110 is shown according to an exemplary embodiment. A gap 126 is formed in the dial 120 corresponding to the gap 116 in the base 112. Like the gap 116 in the base 112, the gap 126 in the dial 120 is defined by an angled lead-in surface 127 on either side. The central cavity 122 is large enough to receive the upper portion 132 of the bolt 130. The upper flange 136 of the bolt 130 rests on an inwardly extending ledge 123 (FIG. 18) in the central cavity 122.

The dial 120 is able to be rotated relative to the base 112 and the bolt 130 between a closed position, in which the dial 120 obstructs access to the central cavity 122, and an open position, in which the dial 120 allows access to the central cavity 122 (e.g., for the insertion or removal of the bolt 130). The dial 120 includes an extension 128 that contacts stops 118 and 119 on either side of the gap 116 to limit the motion of the dial 120 relative to the base 112.

Figure 19A:
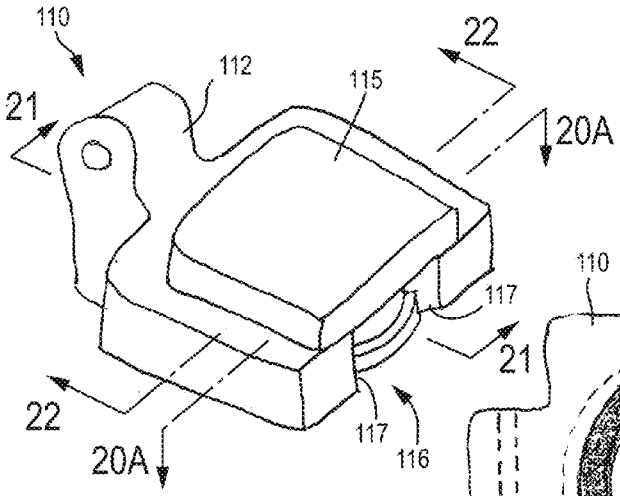
FIG. 19A is a perspective view of the hinge of FIG. 17 in a first or locked configuration.
Figure 20A:
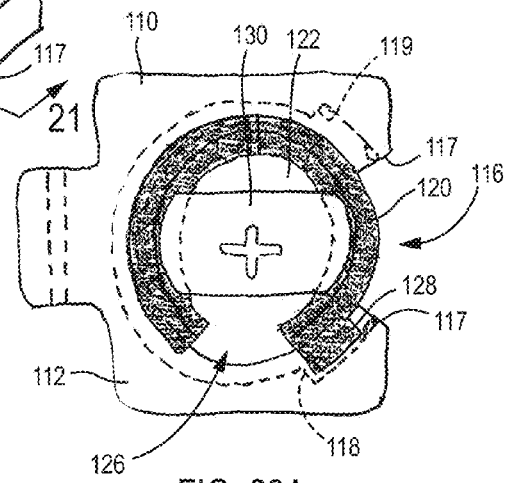
FIG. 20A is a top view of the hinge of FIG. 19A without the top flange of the turn dial.

As shown in FIG. 19A and 20A, in the closed position, the dial 120 is rotated such that the extension 128 contacts the stop 118. The gap 126 in the dial 120 is not aligned with the gap 116 in the base 112, preventing the bolt 130 from being removed from the central cavity 122 and coupling the hinge 110 to the bolt 130 and, therefore, the seat 40 to the toilet 30. Upward movement of the hinge 110 relative to the bolt 130 is limited by the contact of the ledge 123 and the upper flange 136.

Figure 19B:
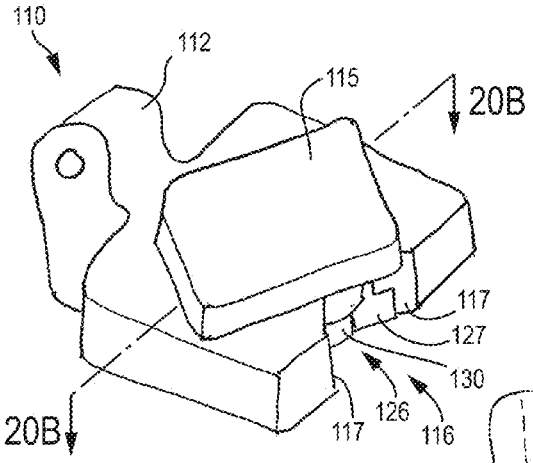
FIG. 19B is a perspective view of the hinge of FIG. 17 in a second or unlocked configuration.
Figure 20B:
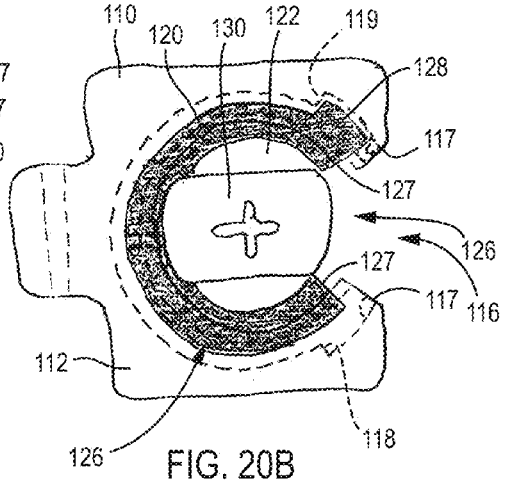
FIG. 20B is a top view of the hinge of FIG. 19B without the top flange of the turn dial.
Figure 22:
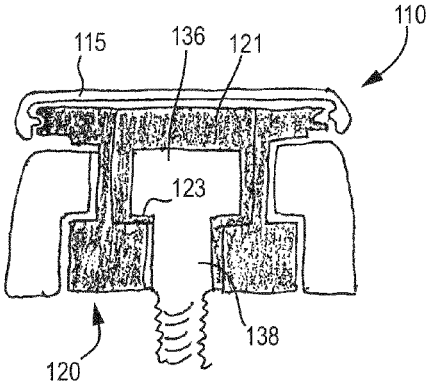
FIG. 22 is a cross section of the hinge of FIG. 19A taken along line 22-22.
Figure 21:
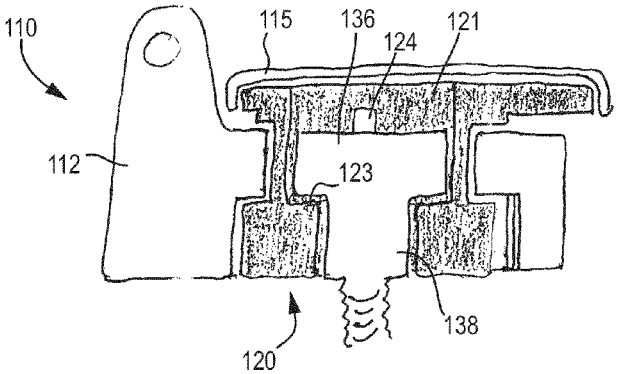
FIG. 21 is a cross section of the hinge of FIG. 19A taken along line 21-21.

As shown in FIG. 19B and 20B, in the opened position, the dial 120 is rotated such that the extension 128 contacts the stop 119. The gap 126 in the dial 120 is aligned with the gap 116 in the base 112, creating an open passage to the central cavity 122 and allowing the bolt 130 to be inserted into the central cavity 122 or removed from the central cavity 122. The widths of the gap 116 and the gap 126 may be configured such that the flats 134 of the bolt 130 allow clearance between the upper portion 132 and the lead in surfaces 117 and 127. In this way, the bolt 130 can be inserted into the central cavity 122 without distorting the hinge 110. If the hinge 110 is coupled to a round bolt 130, the contact portion 138 forces the base 112 and the dial 120 to flex outward as the bolt 130 is inserted into the central cavity 122. Continued force applied to the hinge 110 causes the bolt 130 to pass through the openings 116 and 126 until it is received in the central cavity 122.

The outwardly extending flange 121 (FIG. 18) is shaped such that, when the dial 120 is in the closed position, the flange 121 is aligned with the base 110. When the dial 120 is in the open position, the flange 121 is angled relative to the base 110. In this way, the flange 121 gives a visual indication to allow the user to easily determine if the hinge 110 is opened or closed.

Figure 23:
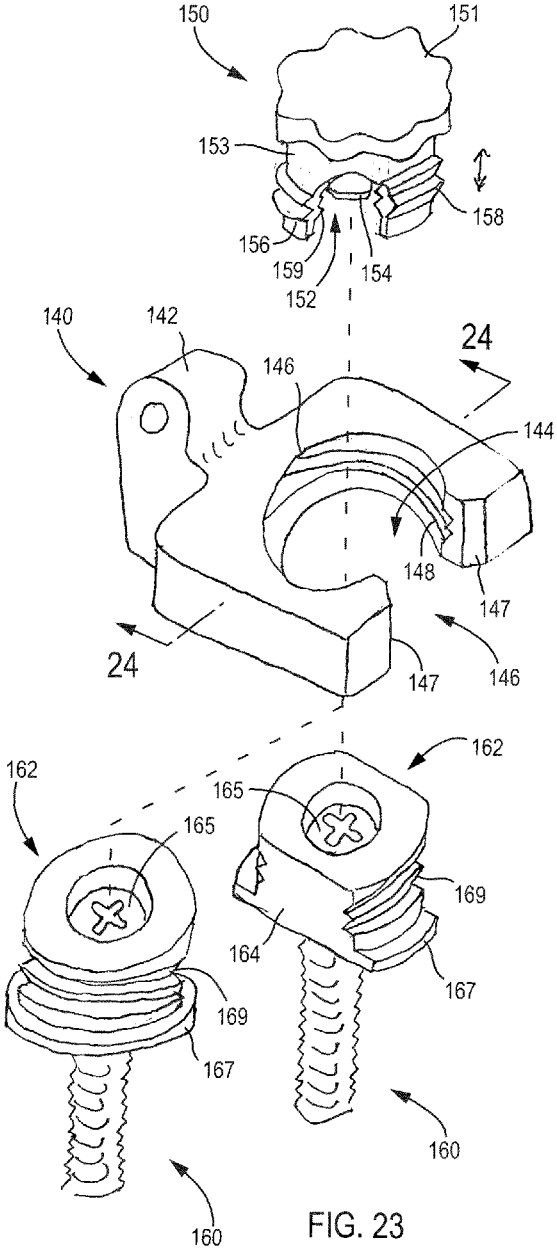
FIG. 23 is an exploded view of a hinge, according to another exemplary embodiment.
Figure 24B:
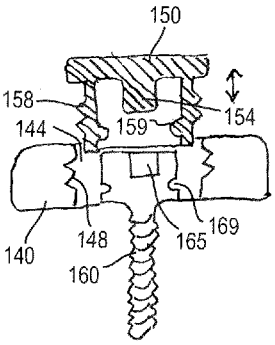
FIG. 24B is a cross section of the hinge of FIG. 23 taken along line 24-24 according to an alternative embodiment.
Figure 24A:
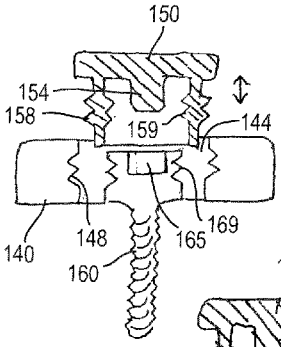
FIG. 24A is a cross section of the hinge of FIG. 23 taken along line 24-24.
Figure 24C:
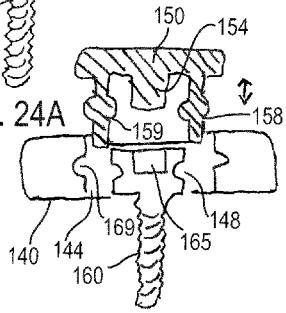
FIG. 24C is a cross section of the hinge of FIG. 23 taken along line 24-24 according to an alternative embodiment.

Referring now to FIGS. 23-24C, a hinge 140 is shown according to other exemplary embodiments. The hinge 140 includes a base 142 and a moveable dial 150 that allows a gap 146 in the base 142 to be manually opened and closed. Similar to the hinge 50, the hinge 140 may also include angled lead-in surface 147 on either side of the gap 146.

The dial 150 is of a cup-shaped body with a central cavity 152 defined by a top with an extending flange 151 and a cylindrical side wall 153. The dial 150 further includes a protrusion 154 that extend downward into the central cavity 152. The base 142 includes a circular opening 144 that receives the dial 150. The flange 151 remains above the base 142 when the side wall 153 of the dial 150 is inserted into the circular opening 144. The flange 151 may be ergonomically shaped to allow a user to rotate the dial 150 relative to the base 142.

Similar to the bolt 130 used with the hinge 110, the bolt 160 may be a round bolt 160, or may be a narrowed bolt 160 that includes flats 164 on the upper portion 162 of the bolt. The narrowed upper portion 162 can pass through the gap 146 without applying pressure to flex the hinge 140. The upper portion 162 may include a recess 165. A lower flange 167 may be provided to facilitate the alignment of the bolt 160 relative to the hinge 140.

External features 158 on the side wall 153 of the dial 150 engage features 148 on the circular opening 144 of the hinge 140 and internal features 159 on the side wall 153 of the dial 150 engage features 169 on the upper portion 162 of the bolt 160 to retain the dial 150 in the circular opening 144 and, therefore, couple the hinge 140 to the bolt 160.

As shown in FIGS. 23 and 24A, according to one exemplary embodiment, the features 148, 158, 159, and 169 are threads or snaps. As the dial 150 is turned or pulled, external features 158 engage features 148 and internal features 159 engage features 169 to advance or withdraw the side wall 153 into the circular opening 144.

As shown in FIG. 24B, according to another exemplary embodiment, features 148 and 158 are threads, while feature 159 is ridge and feature 169 is a slot. As the dial 150 is turned, external features 158 engage features 148 to advance or withdraw the side wall 153 into the circular opening 144. When the dial 150 is inserted completely into the hinge 140 (e.g., such that the flange 151 rests on the hinge 140), the internal feature 159 is received in the feature 169 to couple the dial 150 to the bolt 160 with a snap fit.

As shown in FIG. 24C, according to another exemplary embodiment, external feature 158 and internal feature 159 are ridges and features 148 and 169 are slots. The dial 150 is pushed into the circular opening 144. When the dial 150 is inserted completely into the hinge 140 (e.g., such that the flange 151 rests on the hinge 140), the external feature 158 is received in the feature 169 and the internal feature 159 is received in the feature 148 to couple the dial 150 to the bolt 160 with a snap fit.

In the opened position, the dial 150 is withdrawn from the circular opening 144 creating an open passage for the bolt 160 through the gap 146. The hinge 140 and the dial 150 may each include a stop 149 and 156, respectively, if the coupling features 148 and 158 are threads. The stops 149 and 156 cooperate to limit the upward motion of the dial 150 such that, in the opened position, the dial 150 is clear of the bolt 160, but remains coupled to the hinge 140. If the external feature 158 on the dial is a ridge configured to form a snap fit, the stop 149 may be a rim or lip about the periphery of the circular opening 144 that prevents the dial from being removed completely from the circular opening 144. In other embodiments, the dial 150 may be allowed to be removed completely from the hinge 140.

The widths of the gap 146 may be configured such that the flats 164 of the bolt 160 allow clearance between the upper portion 162 and the lead in surfaces 147. In this way, the bolt 160 can be inserted into the circular opening 144 without distorting the hinge 140. If the hinge 140 is coupled to a round bolt 160, the upper portion 162 may cause the base 142 to flex outward as the bolt 160 is inserted into the circular opening 144. Continued force applied to the hinge 140 causes the bolt 160 to pass through the gap 146 until it is received in the circular opening 144.

In the closed position, the dial 150 is seated in the circular opening 144, obstructing the gap 146 and preventing the bolt 160 from being removed from the circular opening 144 through the gap 146. In this way, the hinge 140 is coupled to the bolt 160 and, therefore, the seat 40 is coupled to the toilet 30. In the closed position, the protrusion 154 is received in the recess 165.

Referring now to FIGS. 25-28, a hinge 170 is shown according to another exemplary embodiment. The hinge 170 includes a base 172 and an engagement portion 174 with a gap or opening 176 opposite of the base 172 defined by angled lead-in surfaces 177. A hinged cover 180 allows the gap 176 in the base 172 to be manually opened and closed. The hinge 170 receives a bolt 190 through the gap 176 into the engagement portion 174. The bolt 190 includes an upper portion 192 with a recess 195 and a lower flange 197. There is a clearance between the bolt 190 and the opening 176, allowing the bolt 190 to enter the engagement portion 174 without distorting the hinge 170. The lower flange 197 is received in a hollow or recess 178 in the engagement portion 174, preventing the hinge from moving in a vertical direction when the bolt 190 is in the engagement portion 174.

Figure 25:
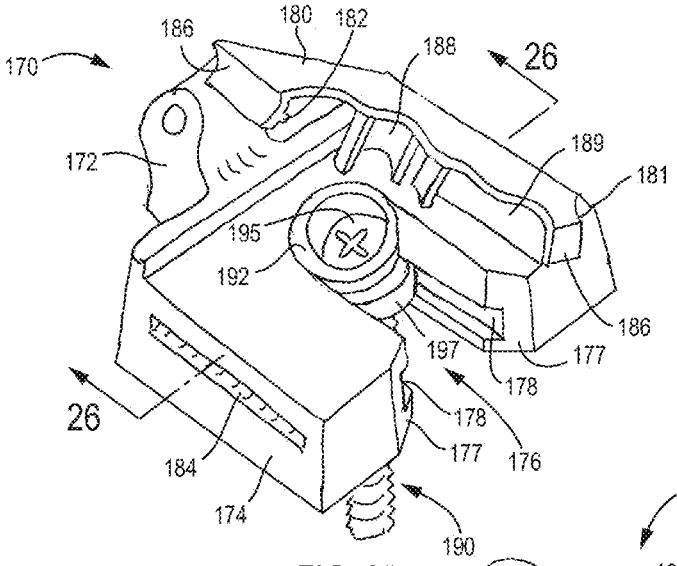
FIG. 25 is a perspective view of a hinge, according to another exemplary embodiment.
Figure 27:
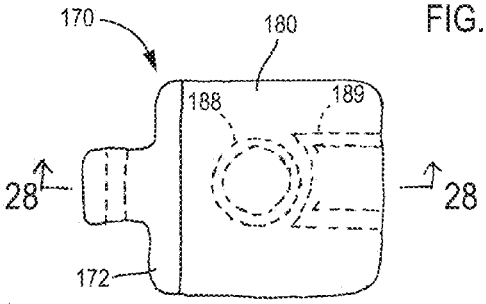
FIG. 27 is a top view of the hinge of FIG. 25 with the cover in a closed configuration.
Figure 28:
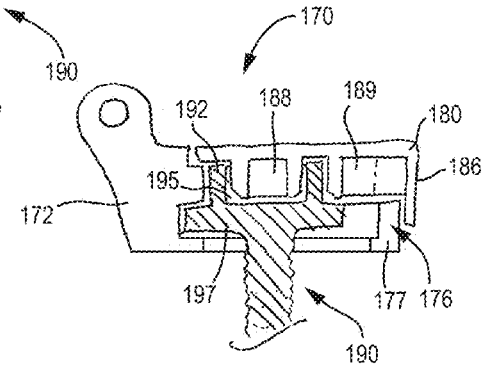
FIG. 28 is a cross-section of the hinge of FIG. 27 taken along line 28-28.
Figure 26:
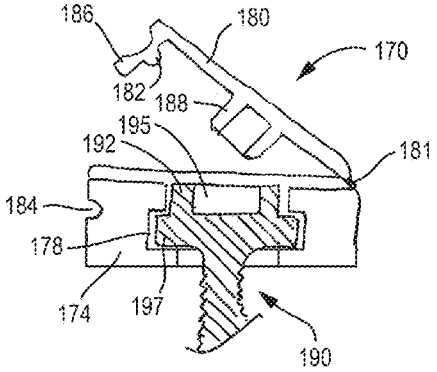
FIG. 26 is a cross section of the hinge in FIG. 25 taken along line 26-26.

The integrally formed cover 180 is coupled to the hinge 170 along one side of engagement portion 174 with a living hinge 181. The cover 180 is moveable between an open position, in which the upper portion 192 of the bolt 190 is accessible, and a closed position in which the bolt 190 is concealed from view. The cover 180 is retained in the closed position with a snap fit between one or more projections 182 (e.g., snaps, protrusions, pegs, etc.) that are received in corresponding recesses 184 (e.g., sockets, etc.). As shown in FIGS. 25-26, the cover 180 may include a rim 186 (e.g., lip, side wall, etc.) along one side. One or more projections 182 may extend inwardly from the rim 186 to be received in recesses 184 formed on an outer side wall of the engagement portion 174.

The cover 180 includes a first protrusion 188 and a second protrusion 189. In the open position, the cover 180 does not obstruct the movement of the bolt 190. The upper portion 192 of the bolt 190 can be inserted into the engagement portion 174 through the opening 176. Once the bolt 190 is seated in the engagement portion 174, the cover 180 can be closed. In the closed position, the first protrusion 188 is received in the recess 195 in the bolt 190 and the second protrusion 189 is received in the gap 176. The first protrusion 188 and the second protrusion 189 act as locks to constrain the horizontal movement via the bolt 190 relative to the hinge 170 to retain the bolt 190 in the engagement portion 174 and couple the hinge 170 to the bolt 190.

Figure 29:
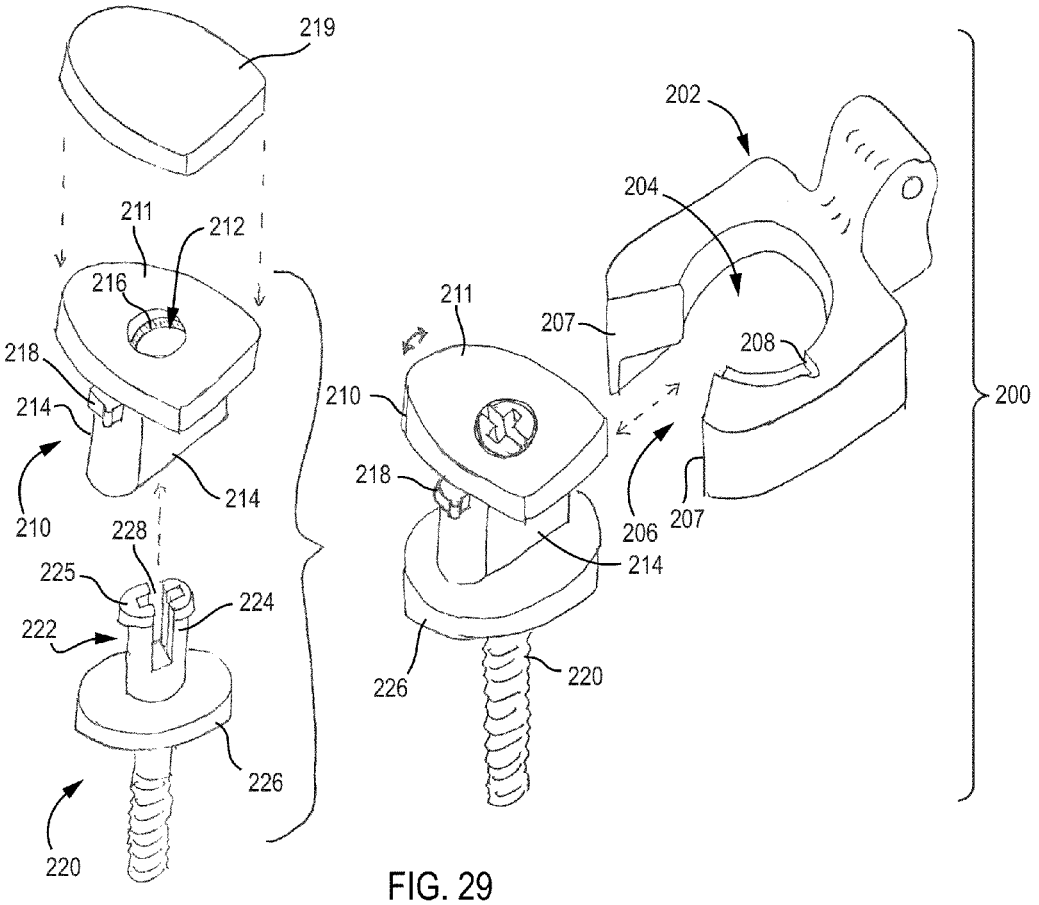
FIG. 29 is an exploded view of a hinge, according to another exemplary embodiment.
Figure 30:
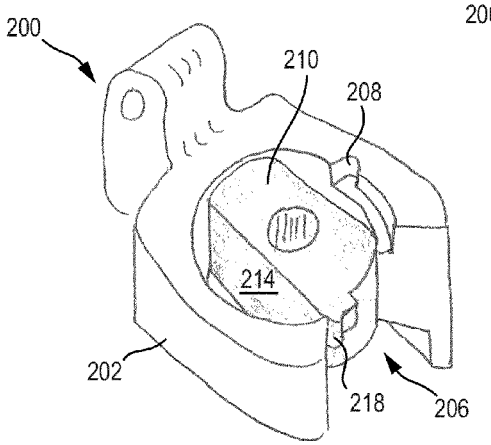
FIG. 30 is a perspective view of the hinge of FIG. 29 in an unlocked configuration.
Figure 31:
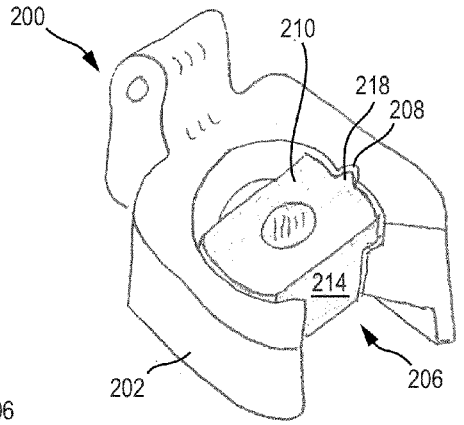
FIG. 31 is a perspective view of the hinge of FIG. 29 in a locked configuration.

Referring now to FIGS. 29-31, a hinge 200 is shown according to another exemplary embodiment. The hinge 200 includes a base 202 and a moveable dial 210. The base 202 includes a circular opening 204 that receives the dial 210 through a gap 206 in the base 202. Similar to the hinge 50, the base 202 may also include angled lead-in surface 207 on either side of the gap 206.

The dial 210 is coupled to a bolt 220 and is rotatable in the circular opening 204. The main body of the dial 210 is an elongated body with parallel flats 214 and a central cavity 212 (e.g., hole, aperture, etc.) that receives the bolt 220. The flats 214 allow to the dial 210 to be inserted into the circular opening 204 through the gap 206, as shown in FIG. 30. When the dial 210 is rotated in the circular opening 204 such that the flats 214 are not parallel to the gap 206, the dial 210 is prevented from passing through the gap 206 and the dial 210 and bolt 220 are therefore coupled to the base 202, as shown in FIG. 31. The dial 210 includes a feature 218 (e.g., tab, protrusion, bump, projection, etc.) that engages a corresponding stop 208 on the base 202 to limit the rotation of the dial 210 relative to the base 202. The stop 208 and the feature 218 cooperate to provide a tactile feedback to the user when the dial 210 is rotated into the closed position. The feature 218 and stop 208 may also include a snap functionality to facilitate keeping the dial 210 in the locked position.

An outwardly extending flange 211 remains above the base 202 when the dial 210 is inserted into the circular opening 204. The flange 211 may be shaped to give a visual indication of the orientation of the dial 210 relative to the base 202 (e.g., whether the hinge 200 is locked or unlocked). A cap 219 may be coupled to the flange 211 to conceal the bolt 220 in the central cavity 212.

The bolt 220 includes an upper portion 222 that engages the central cavity 212 of the dial 210 and a flange 226 that extends outward from the upper portion 222. The upper portion 222 includes protrusions or arms 224 with enlarged distal ends 225. The arms 224 are separated by a slot 228 that allows the enlarged ends 225 to flex inward as the upper portion 222 is inserted into the central cavity 212. When the upper portion 222 is fully inserted into the central cavity 212, the enlarged ends 225 flex outward and couple the bolt 220 to the dial 210 with a snap fit. The enlarged ends 225 contact a ledge 216 around the central cavity 212 to retain the upper portion 222 in the central cavity 212. The bolt 220 remains stationary as the dial 210 is turned. When the bolt 220 and the dial 210 are coupled together and the dial 210 is in the circular opening 204 in the base 202, the flange 211 of the dial 210 and the flange 226 of the bolt 220 cooperate to limit the vertical movement of the dial 210 relative to the base 202.

Figure 32:
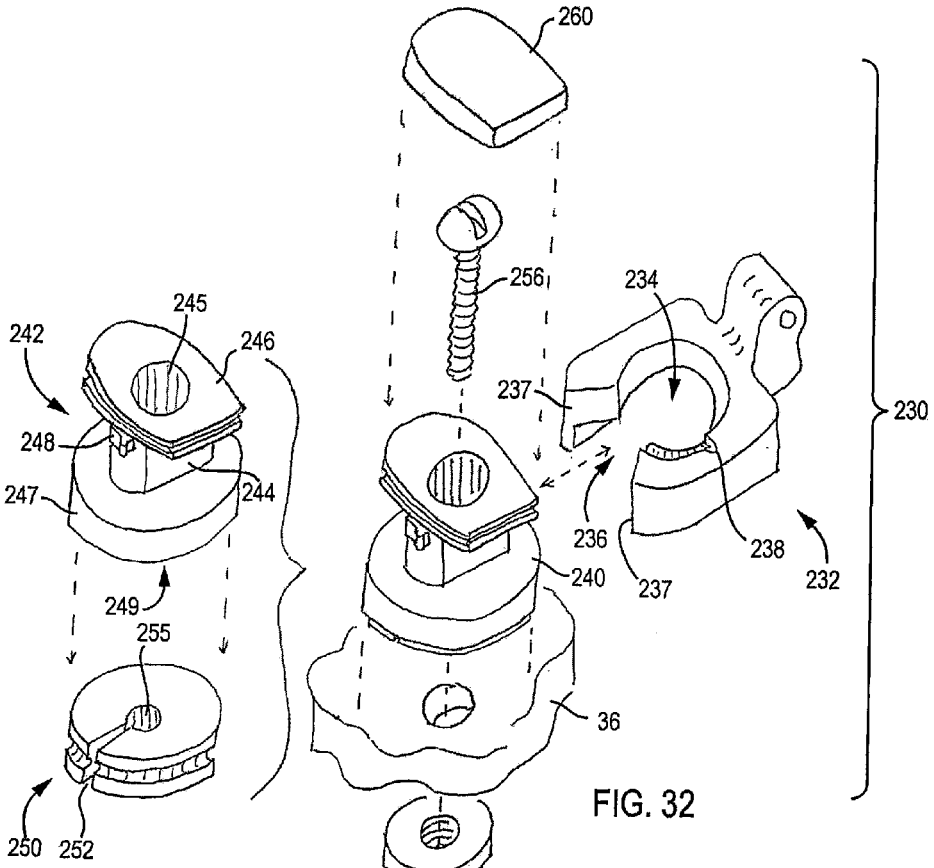
FIG. 32 is an exploded view of a hinge, according to another exemplary embodiment.
Figure 33:
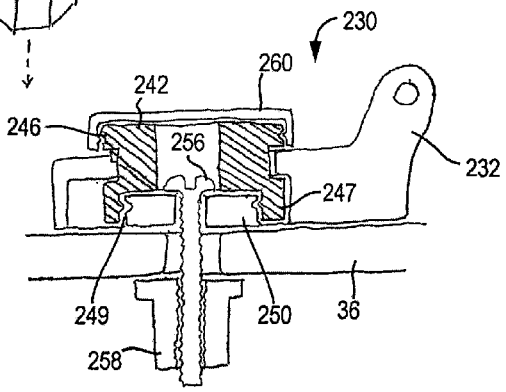
FIG. 33 is a cross section of the hinge of FIG. 32.

Referring now to FIGS. 32-33, a hinge 230 is shown according to another exemplary embodiment. The hinge 230 is similar to hinge 200 and includes a base 232 and a moveable dial 240. The base 232 includes a circular opening 234 that receives the dial 240 through a gap 236 in the base 232. The hinge 230 may also include angled lead-in surface 237 on either side of the gap 236. The dial 240 is coupled to a bolt 256 and is rotatable in the circular opening 234. The bolt 256 engages a nut 258 on the opposite side of the toilet bowl rim 36.

The dial 240 includes an upper portion 242 that is coupled to a lower portion 250 with a snap fit. The upper portion 242 has an elongated portion with parallel flats 244 and a central opening 245 (e.g., hole, aperture, etc.) that receives the bolt 256. The upper portion 242 further includes an outwardly extending upper flange 246 and a lower flange 247. The flats 244 allow to the dial 240 to be inserted into the circular opening 234 through the gap 236, as shown in FIG. 32. When the dial 240 is rotated in the circular opening 234 such that the flats 244 are not parallel to the gap 236, the dial 240 is prevented from passing through the gap 236 and the dial and bolt 256 are therefore coupled to the base 232. The dial 240 includes a feature 248 (e.g., tab, protrusion, bump, projection, etc.) that engages a corresponding stop 238 on the base 232 to limit the rotation of the dial 240 relative to the base 232. The stop 238 and the feature 248 cooperate to provide a tactile feedback to the user when the dial 240 is rotated into the closed position. The feature 248 and stop 238 may also include a snap functionality to facilitate keeping the dial 240 in the locked position.

The upper flange 246 remains above the base 232 when the dial 240 is inserted into the circular opening 234. The flange 246 may be shaped to give a visual indication of the orientation of the dial 240 relative to the base 232 (e.g., whether the hinge 230 is locked or unlocked). A cap or cover 260 may be coupled to the flange 246 to conceal the bolt 256.

The lower portion 250 is a disk-shaped body that is received in a hollow 249 in the lower flange 247 and is coupled to the upper portion 242 with a snap fit, allowing the upper portion 242 to rotate relative to the lower portion 250. The lower portion 250 may include a relief slot 252 to facilitate the coupling of the lower portion 250 to the upper portion 242. The lower portion 250 includes a central opening 255 that is aligned with the central opening 245 in the upper portion 242. The diameter of the central opening 255 is less than the diameter of the central opening 245 and the head of the bolt 256, allowing the threaded portion of the bolt 256 to pass through the central opening 255, but not the head of the bolt 256.

When the bolt 256 is coupled to the dial 240 and the nut 258 and the dial 240 is in the circular opening 234 in the base 232, the upper flange 246 and the lower flange 247 cooperate to limit the vertical movement of the dial 240 relative to the base 232.

Figure 34:
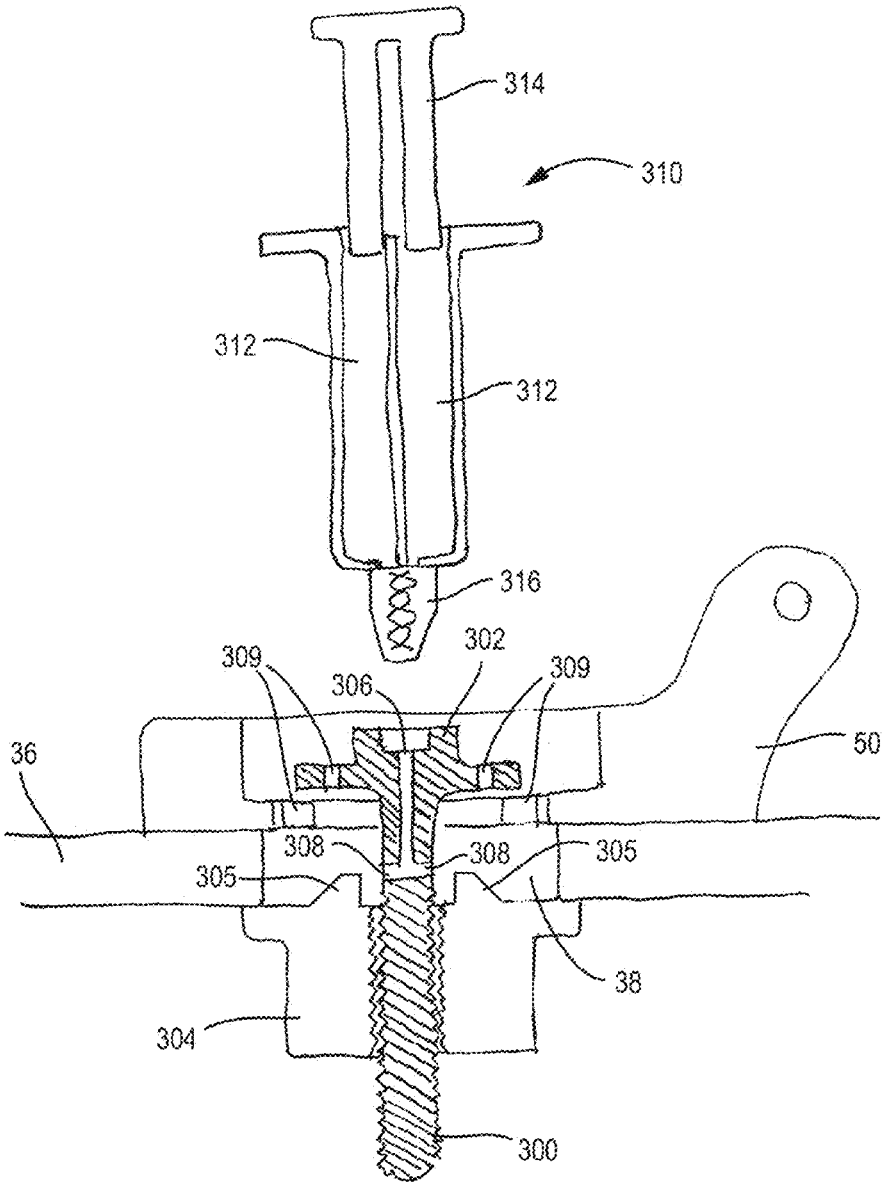
FIG. 34 is a schematic cross-section of a device for injecting a gasket bushing material for a toilet seat hinge post, according to an exemplary embodiment.

Referring now to FIG. 34, a mechanism for creating a gasket bushing for a bolt 300 is shown according to an exemplary embodiment. Similar to the bolt 42 in FIG. 3, the bolt 300 in FIG. 34 is received within an aperture 38 in the toilet flange 36. The bolt 300 includes an upper portion 302. According to an exemplary embodiment, the bolt 300 is a threaded member that engages a threaded nut 304 provided on the opposite side of the flange 36. The aperture 38 has a diameter that is larger than the threaded portion of the bolt 300, but smaller than the nut 304.

A gasket bushing may be provided in the aperture 38 to reduce the lateral movement of the bolt 300 in the aperture 38. According to an exemplary embodiment, the gasket is formed of a gasketing composition, which in one embodiment is a multi-part liquid rubber compound. The liquid is provided in a syringe 310 with multiple chambers 312. A passage 306 is formed in the bolt 300 with outlets 308 located in the aperture 38. Weep holes 309 are provided in the hinge 50 and/or in the upper portion 302 of the bolt 300 to facilitate filling void in aperture 38 if the bolt 300 and the nut 304 are tightened. If the bolt 300 is loosely secured in the aperture 38 (e.g., the bolt 300 and the nut 304 are not tightened), the weep holes 309 may be eliminated and the nut 304 may be tightened after the gasketing compound is injected into the aperture 38.

The compound can be injected into the aperture 38 by depressing a plunger 314, forcing the different parts of the compound out of the chambers 312 to be mixed in the tip 316 and extruded into the passage 306. With the tip 316 inserted into the upper portion of the bolt 302, the compound passes through the passage 306 into the aperture 38 where it can fill the void between the bolt 300 and the toilet bowl flange 36 and cure to form a resilient gasket bushing material. Air is allowed to evacuate through the weep holes 309 as the liquid rubber compound is injected into the void between the bolt 300 and the toilet bowl flange 36.

The nut 304 may include one or more tabs 305 that extend into the aperture 38. As the bushing compound fills the aperture 38, it surrounds the tabs 305 and the tabs are embedded into the resulting bushing. This embedding help to secure the nut 304 and reduces the likelihood that the nut 304 will come loose during the prolonged use of the toilet seat.

Figure 35:
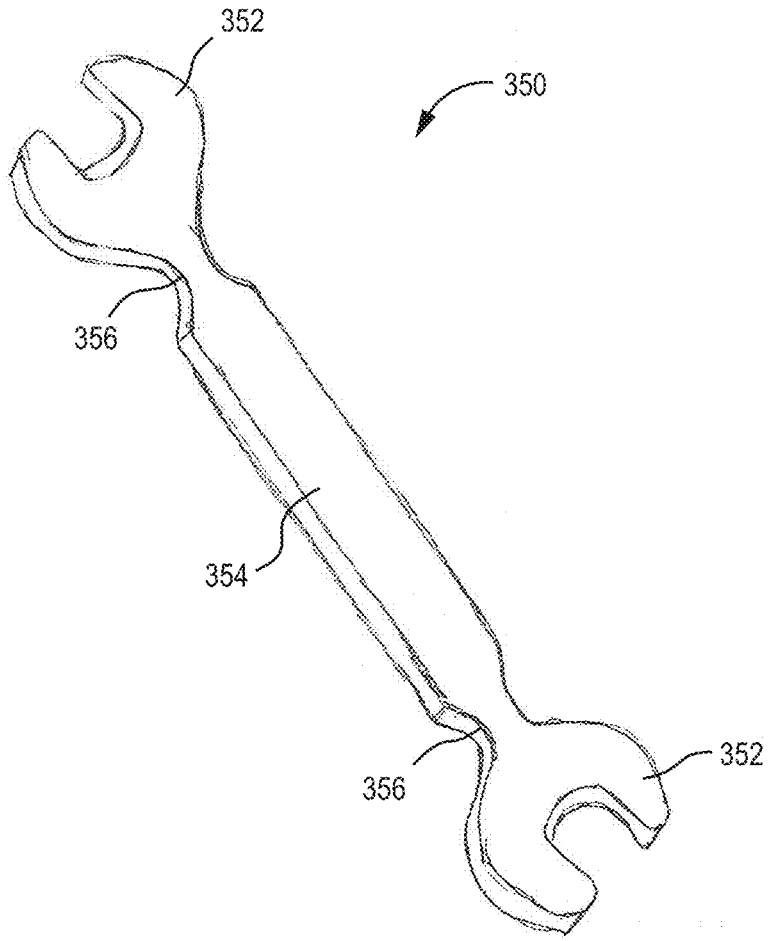
FIG. 35 is a perspective view of a wrench for tightening the fasteners for a toilet seat, according to an exemplary embodiment.

Referring now to FIG. 35, a wrench 350 for tightening the fastening members for a toilet seat is shown according to an exemplary embodiment. The wrench 350 is configured to be a disposable tool with break-away ends 352. The ends 352 are coupled to a handle portion 354 by a frangible portion 356.

To properly fasten a toilet seat cover to the toilet, the threaded fasteners are generally configured to be tightened to a specified torque. The frangible portions 356 are configured to break once they have been used to apply a specified torque to the fastener. By having two ends 352, the wrench 350 may be used to tighten two fasteners to the pre-determined torque.

According to one exemplary embodiment, the frangible portions 356 comprise portions of the handle 354 with a reduced cross-sectional area. In other embodiments, the frangible portions may be achieved through other means, such as scoring, chemical treatment, or the use of different materials.

According to an exemplary embodiment, the wrench 350 is formed from a polymer.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example is manifestly intended to be as broad as possible. For example, unless specifically otherwise noted a single particular element may also encompass a plurality of such particular elements. The invention should therefore not be limited by the above described embodiment, method, and examples, but by all embodiments and methods within the scope and spirit of the invention.

It is also important to note that the construction and arrangement of the elements of the system as shown in the exemplary embodiments is illustrative only. Although only a certain number of embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited.

Further, elements shown as integrally formed may be constructed of multiple parts or elements shown as multiple parts may be integrally formed, the operation of the assemblies may be reversed or otherwise varied, the length or width of the structures and/or members or connectors or other elements of the system may be varied, the nature or number of adjustment or attachment positions provided between the elements may be varied. It should be noted that the elements and/or assemblies of the system may be constructed from any of a wide variety of materials that provide sufficient strength or durability. Accordingly, all such modifications are intended to be included within the scope of the present disclosure. Other substitutions, modifications, changes and omissions may be made in the design, operating conditions and arrangement of the exemplary embodiments without departing from the spirit of the present subject matter.

What is claimed is:

1. A mounting apparatus for coupling a toilet seat to a toilet, the mounting apparatus comprising:

a moveable dial directly coupled to a bolt for connection to the toilet; and a base comprising a top surface, a bottom surface, and a sidewall;

the sidewall defining an opening passing between and through the top surface and the bottom surface;

the sidewall further defining a gap comprising a break in the sidewall from the top surface to the bottom surface such that the opening and gap are sized and configured to horizontally receive the moveable dial through the gap for removably containing the moveable dial in the opening, the base further configured to connect to the toilet seat;

wherein the moveable dial is configured to rotate in the opening of the base such that the moveable dial is rotatable between a locked position, in which the moveable dial and base are engaged thereby locking the toilet to the toilet seat, and an unlocked position, in which the moveable dial and the base are disengaged allowing for the moveable dial to freely move through the gap and the opening of the base, the moveable dial is rotatable independently of the bolt between the locked position and the unlocked position about a longitudinal axis of the bolt.

2. The mounting apparatus of claim 1, wherein the moveable dial comprises:

an elongated body comprising parallel flats and a central cavity for receiving the bolt;

wherein the parallel flats are sized and shaped to (i) allow for the moveable dial to be inserted through the gap and the opening of the base when the moveable dial is in the unlocked position, and (ii) prevent the moveable dial from passing through the gap of the base upon rotation of the moveable dial into the locked position.

3. The mounting apparatus of claim 1, wherein the moveable dial comprises a protrusion configured to engage a stop on the base to limit rotation of the moveable dial relative to the base.

4. The mounting apparatus of claim 1, wherein the moveable dial comprises an outwardly extending flange on an upper portion of the moveable dial, the outwardly extending flange configured to be positioned above the base when the moveable dial is inserted in the opening of the base.

5. The mounting apparatus of claim 4, wherein the bolt comprises a second outwardly extending flange; wherein the second outwardly extending flange of the bolt is parallel to the outwardly extending flange of the moveable dial when the moveable dial and the bolt are coupled to one another; and wherein the outwardly extending flange of the moveable dial and the second outwardly extending flange of the bolt cooperate to limit vertical movement of the moveable dial relative to the base when the moveable dial is inserted in the opening of the base.

6. The mounting apparatus of claim 1, wherein the moveable dial and the bolt are coupled to one another via a snap fit, and wherein the bolt remains stationary relative to the moveable dial when the moveable dial rotates between the unlocked position and the locked position.

7. The mounting apparatus of claim 1, wherein the moveable dial comprises an upper portion and a lower portion, the upper and lower portions coupled to one another via a snap fit.

8. The mounting apparatus of claim 7, wherein the upper portion of the moveable dial comprises an upper outwardly extending flange and a lower outwardly extending flange, and wherein the upper outwardly extending flange and the lower outwardly extending flange cooperate to limit vertical movement of the moveable dial relative to the base when the moveable dial is inserted in the opening of the base.

9. The mounting apparatus of claim 8, wherein the lower portion of the moveable dial comprises a disk-shaped body configured to be received in a hollow portion of the lower outwardly extending flange.

10. A releasable hinge for coupling a toilet seat to a toilet, the releasable hinge comprising:

a moveable dial directly coupled to a bolt for connection to the toilet, the moveable dial comprising an elongated body with parallel flats and a central cavity for receiving the bolt; and a base configured to connect to the toilet seat, the base comprising a top surface, a bottom surface, and a sidewall;

the sidewall defining an opening passing between and through each of the top surface and the bottom surface;

the sidewall further defining a gap comprising a break in the sidewall from the top surface to the bottom surface such that the opening and gap are sized and configured to horizontally receive the moveable dial through the gap for removably containing the moveable dial in the opening;

wherein the parallel flats of the moveable dial are sized and shaped to provide for the moveable dial to rotate in the opening of the base between an unlocked position and a locked position; wherein in the unlocked position the moveable dial and the base are disengaged allowing for the moveable dial to freely move through the gap and the opening of the base; and wherein in the locked position the moveable dial and base are engaged thereby locking the toilet to the toilet seat;

wherein the moveable dial is rotatable independently of the bolt between the locked position and the unlocked position about a longitudinal axis of the bolt.

11. The releasable hinge of claim 10, wherein the moveable dial comprises an outwardly extending flange on an upper portion of the moveable dial, the outwardly extending flange configured to be positioned above the base when the moveable dial is inserted in the opening of the base.

12. The releasable hinge of claim 11, wherein the bolt comprises a second outwardly extending flange; wherein the second outwardly extending flange of the bolt is parallel to the outwardly extending flange of the moveable dial when the moveable dial and the bolt are coupled to one another; and wherein the outwardly extending flange of the moveable dial and the second outwardly extending flange of the bolt cooperate to limit vertical movement of the moveable dial relative to the base when the moveable dial is inserted in the opening of the base.

13. The releasable hinge of claim 10, wherein the moveable dial comprises an upper portion and a lower portion, the upper and lower portions coupled to one another via a snap fit.

14. The releasable hinge of claim 13, wherein the upper portion of the moveable dial comprises an upper outwardly extending flange and a lower outwardly extending flange, and wherein the upper outwardly extending flange and the lower outwardly extending flange cooperate to limit vertical movement of the moveable dial relative to the base when the moveable dial is inserted in the opening of the base.

15. The releasable hinge of claim 10, wherein the moveable dial comprises a protrusion configured to engage a stop on the base to limit rotation of the moveable dial relative to the base.

16. The releasable hinge of claim 10, wherein the base comprises angled lead-in surfaces on either side of the gap.

* * * * *